US007896318B1

(12) United States Patent
Gibbs et al.

(10) Patent No.: US 7,896,318 B1
(45) Date of Patent: Mar. 1, 2011

(54) TERRAIN-CONFORMING BARRIER

(75) Inventors: Edward L. Gibbs, Tulsa, OK (US); Fred L. Givens, Tulsa, OK (US); Gary W. Vonnahme, Broken Arrow, OK (US)

(73) Assignee: Edward L. Gibbs, Tulsa, OK (US)

( * ) Notice: Subject to any disclaimer, the term of this patent is extended or adjusted under 35 U.S.C. 154(b) by 0 days.

(21) Appl. No.: 12/861,500

(22) Filed: Aug. 23, 2010

Related U.S. Application Data

(62) Division of application No. 10/904,871, filed on Dec. 1, 2004.

(60) Provisional application No. 60/553,658, filed on Mar. 15, 2004, provisional application No. 60/522,769, filed on Nov. 4, 2004.

(51) Int. Cl.
*E04H 17/14* (2006.01)

(52) U.S. Cl. ..... 256/67; 256/22; 256/DIG. 2

(58) Field of Classification Search ..... 256/1, 256/21, 22, 59, 65.01, 67, DIG. 2
See application file for complete search history.

(56) References Cited

U.S. PATENT DOCUMENTS

| | | | |
|---|---|---|---|
| 313,825 | A | 3/1885 | Jones |
| 895,297 | A | 8/1908 | Peter |
| 1,630,492 | A | 5/1927 | Kusterle |
| 1,782,234 | A | 11/1930 | Hofmann |
| 1,906,296 | A | 5/1933 | Williams |
| 2,218,954 | A | 10/1940 | Gustafson |
| 2,482,592 | A | 9/1949 | Miller et al. |
| 2,563,529 | A | 8/1951 | Hawkins |
| 2,563,530 | A | 8/1951 | Hawkins |
| 2,590,929 | A | 4/1952 | Bush |
| 2,655,345 | A | 10/1953 | Lindman |
| 2,909,361 | A | 10/1959 | Dotson |

(Continued)

FOREIGN PATENT DOCUMENTS

| | | | |
|---|---|---|---|
| DE | 806388 | A | 6/1951 |

(Continued)

OTHER PUBLICATIONS

Althouse et al., Modern Welding (1997) pp. 354 and 630, published in the United States in 1997.

(Continued)

*Primary Examiner*—Victor MacArthur
(74) *Attorney, Agent, or Firm*—Gary Peterson

(57) ABSTRACT

A barrier, such as fence panel, is formed from a plurality of channel-shaped rails and plurality of upright members. Each upright member traverses the rail channels of the rails forming the barrier and is mechanically connected to the rail, such that the upright member is selectively tiltable with respect to the rail within an angular adjustment range. The mechanical connection between rail and upright member may be formed by a weld, such as a resistance weld, by a permanent adhesive, or with a fastener such as bolt or screw. A tab that extends from the rail web may be used to connect a rail to an upright member. The tab may depend from a bracket installed within the rail channel, or may be cut out and bent into the channel from the web. The tab is rotatable about an axis situated at or adjacent the web.

12 Claims, 27 Drawing Sheets

U.S. PATENT DOCUMENTS

| | | | | | |
|---|---|---|---|---|---|
| 2,932,488 | A | | 4/1960 | Dotson | |
| 3,033,532 | A | | 5/1962 | McFall | |
| 3,067,985 | A | | 12/1962 | Cusack | |
| 3,083,951 | A | | 4/1963 | Huret | |
| 3,113,760 | A | * | 12/1963 | Huret et al. | 256/21 |
| 3,139,504 | A | | 6/1964 | Ramstein et al. | |
| 3,202,401 | A | | 8/1965 | Bastia | |
| 3,240,297 | A | | 3/1966 | Desy | |
| 3,244,406 | A | * | 4/1966 | Garofola | 256/21 |
| 3,306,586 | A | | 2/1967 | Green | |
| 3,343,811 | A | | 9/1967 | Kusel et al. | |
| D210,519 | S | | 3/1968 | Kusel et al. | |
| 3,385,567 | A | | 5/1968 | Case et al. | |
| 3,395,489 | A | | 8/1968 | Banse | |
| 3,410,544 | A | | 11/1968 | Beck | |
| 3,517,474 | A | | 6/1970 | Lanternier | |
| 3,596,880 | A | | 8/1971 | Greenberg | |
| 3,597,568 | A | | 8/1971 | Rach | |
| 3,612,291 | A | | 10/1971 | Skubic | |
| 3,648,982 | A | | 3/1972 | Sabel et al. | |
| 3,704,005 | A | * | 11/1972 | Kusel | 256/22 |
| 3,717,964 | A | | 2/1973 | Brown et al. | |
| 3,780,253 | A | | 12/1973 | Senn | |
| 3,799,506 | A | | 3/1974 | Schwartz | |
| 3,854,192 | A | | 12/1974 | O'Konski | |
| 3,858,850 | A | * | 1/1975 | Maxcy et al. | 256/22 |
| 3,940,586 | A | | 2/1976 | Stearns et al. | |
| 3,956,855 | A | | 5/1976 | Walker | |
| 3,995,403 | A | | 12/1976 | Nickell | |
| 4,023,683 | A | | 5/1977 | Vargo | |
| 4,174,475 | A | | 11/1979 | Senn | |
| 4,188,019 | A | | 2/1980 | Meredith | |
| 4,204,375 | A | | 5/1980 | Good | |
| 4,238,117 | A | | 12/1980 | Newman | |
| 4,339,114 | A | | 7/1982 | Deike | |
| 4,360,285 | A | | 11/1982 | Magness | |
| 4,383,782 | A | | 5/1983 | Pillifant, Jr. | |
| 4,445,232 | A | | 5/1984 | Nelson | |
| 4,533,121 | A | | 8/1985 | Basey | |
| 4,616,453 | A | | 10/1986 | Sheppard, Jr. et al. | |
| D293,718 | S | | 1/1988 | Poma | |
| 4,723,760 | A | | 2/1988 | O'Sullivan | |
| 4,789,768 | A | | 12/1988 | Tobita et al. | |
| 4,883,256 | A | | 11/1989 | Hebda | |
| 4,917,284 | A | | 4/1990 | Candiracci | |
| 4,982,933 | A | | 1/1991 | Schultz | |
| 4,995,591 | A | | 2/1991 | Humphrey et al. | |
| 5,056,283 | A | | 10/1991 | Sapinski | |
| D324,506 | S | | 3/1992 | Phillips | |
| 5,136,813 | A | | 8/1992 | Gibbs et al. | |
| 5,192,054 | A | | 3/1993 | Sharp | |
| 5,272,838 | A | | 12/1993 | Gibbs | |
| 5,274,973 | A | | 1/1994 | Liang | |
| 5,345,723 | A | | 9/1994 | Gibbs | |
| 5,403,985 | A | | 4/1995 | Ahn | |
| 5,443,244 | A | | 8/1995 | Gibbs | |
| 5,927,041 | A | | 7/1999 | Sedlmeier et al. | |
| 5,956,916 | A | | 9/1999 | Liss | |
| 5,964,071 | A | | 10/1999 | Sato | |
| 5,971,365 | A | | 10/1999 | Pigott et al. | |
| 6,029,954 | A | | 2/2000 | Murdaca | |
| D423,325 | S | | 4/2000 | Liss | |
| 6,047,519 | A | | 4/2000 | Bagn | |
| D424,213 | S | | 5/2000 | Chaney et al. | |
| 6,073,414 | A | | 6/2000 | Garris et al. | |
| 6,142,704 | A | | 11/2000 | Coyne | |
| 6,151,772 | A | | 11/2000 | Pigott et al. | |
| 6,176,043 | B1 | | 1/2001 | Gibbs | |
| 6,176,053 | B1 | | 1/2001 | St. Germain | |
| 6,189,277 | B1 | | 2/2001 | Boscamp | |
| 6,199,336 | B1 | | 3/2001 | Poliquin | |
| 6,254,064 | B1 | | 7/2001 | Gibbs | |
| 6,299,143 | B1 | | 10/2001 | Valentine | |
| 6,301,854 | B1 | | 10/2001 | Daudet et al. | |
| 6,311,957 | B1 | | 11/2001 | Driscoll et al. | |
| D465,856 | S | | 11/2002 | Givens et al. | |
| D466,620 | S | | 12/2002 | Givens et al. | |
| D467,669 | S | | 12/2002 | Givens et al. | |
| D468,028 | S | | 12/2002 | Givens et al. | |
| 6,519,908 | B1 | | 2/2003 | Masterson et al. | |
| 6,612,087 | B2 | | 9/2003 | diGirolamo et al. | |
| 6,627,832 | B2 | | 9/2003 | Vittone | |
| 6,631,887 | B1 | | 10/2003 | Walmsley | |
| 6,648,304 | B1 | | 11/2003 | Zhu | |
| 6,739,583 | B2 | | 5/2004 | Ryon | |
| 6,752,385 | B2 | | 6/2004 | Zen et al. | |
| 6,811,145 | B2 | | 11/2004 | Gibbs et al. | |
| 6,811,146 | B1 | | 11/2004 | Giralt | |
| 6,817,155 | B2 | | 11/2004 | Larson | |
| 6,843,035 | B1 | | 1/2005 | Glynn | |
| 6,874,767 | B1 | | 4/2005 | Gibbs | |
| 6,912,787 | B1 | | 7/2005 | Ruble et al. | |
| 6,969,051 | B1 | | 11/2005 | Gibbs | |
| 7,071,439 | B2 | | 7/2006 | Gibbs et al. | |
| 7,086,642 | B1 | | 8/2006 | O'Brien | |
| 7,090,202 | B1 | | 8/2006 | O'Brien | |
| 7,159,853 | B2 | | 1/2007 | Gibbs et al. | |
| 7,282,659 | B1 | | 10/2007 | Gibbs et al. | |
| 7,396,002 | B1 | | 7/2008 | Gibbs | |
| 7,621,510 | B2 | | 11/2009 | Gibbs et al. | |
| 2003/0234391 | A1 | | 12/2003 | Sheppard et al. | |

FOREIGN PATENT DOCUMENTS

| | | | |
|---|---|---|---|
| DE | 3716343 | A1 | 12/1988 |
| GB | 177547 | A | 4/1922 |
| GB | 2093513 | A1 | 9/1982 |
| JP | 53-69439 | A | 6/1978 |
| JP | 10252212 | A | 9/1998 |

OTHER PUBLICATIONS

Amstead et al., Manufacturing Processes, Seventh Edition, pp. 199-203, published in the United States in 1977.

Lindberg, Process and Materials of Manufacture, pp. 316-317, published in the United States in 1965.

Society of Manufacturing Engineers, Tool and Manufacturing Engineers Handbook, vol. IV, pp. 9-101, 9-119. 9-120, 9-121 and 9-122, published in the United States in 1987.

American Welding Society, Welding Handbook, Seventh Edition, vol. 3 (1980), pp. 21 and 28-30, published in the United States in 1980.

Ameristar Fence Products, Inc., "Aegis Ornamental Steel Residential Fencing," pp. 1-8, published in the United States no later than Apr. 2001.

Ameristar Fence Products, Inc., "Aegis II Industrial & Aegis Plus Commercial Ornamental Steel Fence and TransPort Ornamental Gates," pp. 1-18, published in the United States in Aug. 2000.

Ameristar Fence Products, Inc., "2002 Price Catalog," all pages, published in the Unted States by at least Nov. 1, 2001 (prices redacted).

* cited by examiner

TERRAIN-CONFORMING BARRIER

CROSS-REFERENCE TO RELATED APPLICATIONS

This application is a division of U.S. patent application Ser. No. 10/904,871, filed Dec. 1, 2004, which claims the benefit of U.S. Provisional Application No. 60/553,658, filed Mar. 15, 2004, and U.S. Provisional Application No. 60/522,769, filed Nov. 4, 2004. The entire disclosure of each of these applications is incorporated by reference.

FIELD OF THE INVENTION

The present invention relates generally to barriers to pedestrians or vehicles, and more particularly to fences and fence components formed with rails and upright members that are tiltable with respect to each other.

SUMMARY OF THE INVENTION

The present invention comprises a rail having an elongate web with a plurality of longitudinally spaced openings formed therein. A pair of opposed side walls extending from the web to define a rail channel. The rail further comprises a plurality of longitudinally spaced tabs, with each tab extending from a position at or adjacent the web. Each tab is situated adjacent a corresponding web opening in a one-to-one relationship.

The present invention further comprises a rail having an elongate web and a pair of opposed side walls extending from the web to define a rail channel. The rail further comprises a plurality of longitudinally spaced tabs, each tab extending from a position at or adjacent the web. The web is has no opening formed therein adjacent any of the plural tabs.

The present invention also comprises a rail characterized by an elongate web having a plurality of longitudinally spaced openings formed therein. A pair of opposed side walls extending from the web to define a rail channel, and a plurality of longitudinally spaced tabs extending from a position at or adjacent the web. Each tab has opposed first and second surfaces. The first surface of the tab is substantially planar and has a weldable projection formed thereon.

The present invention additionally comprises a rail having an elongate web and opposed side walls, which cooperate to define a rail channel. A plurality of longitudinally spaced brackets is secured within the rail channel. Each bracket supports a tab that depends within the rail channel.

The present invention further comprises a barrier formed from a plurality of rails disposed in spaced and parallel relationship. Each rail comprises an elongate web, a pair of spaced side walls which depend from the web and cooperate with the web to define a rail channel, and a plurality of longitudinally spaced tabs, each tab extending from a position at or adjacent the web. The barrier further comprises a plurality of upright members, each of which extends in transverse relationship to the plural rails. A mechanical connection is formed between each upright member and each rail at the tab.

The present invention further comprises a barrier formed from at least one rail having an elongate web and opposed side walls, which cooperate to define a rail channel, and an upright member. The upright member extends in transverse relationship to the rail, traverses the rail channel, and is mechanically connected to the rail. The upright member is selectively tiltable with respect to the rail within an angular adjustment range.

The present invention further comprises a method of installing a modular fence panel between spaced first and second fence posts installed in parallel relationship on a terrain. The fence panel comprises at least one rail having a first end and a second end. The rail is characterized by an elongate web and opposed side walls, which cooperate to define a rail channel. The panel further comprises an upright member that extends in transverse relationship to the rail and traverses the rail channel. The upright member mechanically connected to the rail and tiltable relative thereto within an angular adjustment range. The first end of the rail is secured to the to the first post, and second end of the rail is secured to the second post. The upright member is tilted relative to the rail, if necessary, so that the upright member extends parallel to the posts.

BRIEF DESCRIPTION OF THE DRAWINGS

FIG. 9 is a cross-sectional side view of the rail and upright member shown in FIG. 7, taken along line 9-9.

FIG. 38 is a cross-sectional view of the upper rail used to form the panel shown in FIG. 15, in an assembled state with the bracket of FIG. 32 and an upright member.

FIG. 48 is a cross-sectional view of the assembled upper rail, bracket and upright member shown in FIG. 47, taken along line 48-48.

FIG. 49 is a cross-sectional view of the assembled upper rail, bracket and upright member shown in FIG. 48, showing the upright member in a tilted relationship to the upper rail.

DETAILED DESCRIPTION

Figure 1:
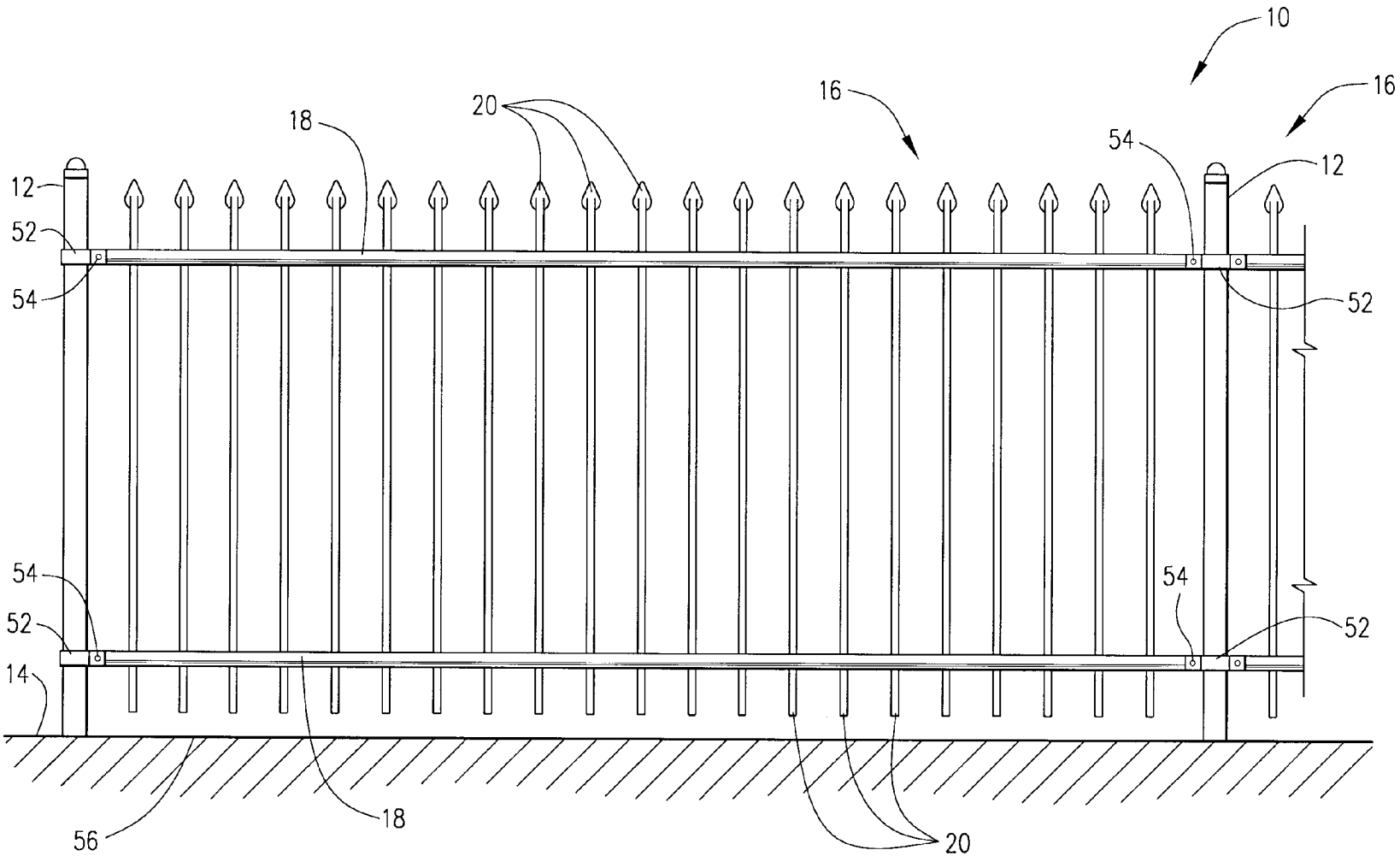
FIG. 1 is a front elevational view of a section of fence embodying the present invention, showing a panel supported between a pair of adjacent posts on a flat supporting terrain. The terrain is shown in cross section.

The present invention comprises a barrier, such as a fence, balustrade, or gate, formed from at least one, and preferably a plurality of, elongate rails, and at least one, and preferably a plurality, of upright members, such as pickets. FIG. 1 shows the barrier of the present invention as embodied in a fence, generally designated by reference numeral 10. The entire disclosure of this application is incorporated by reference.

The fence 10 preferably comprises a plurality of spaced posts 12, preferably identical in construction, each of which is securely anchored at its base into a substrate 14, such as the ground or an underground mass of concrete. The posts 12 are preferably vertical. As used herein, "vertical" should be understood to designate a direction parallel to the earth's gravity. The posts 12 are situated along the boundary of the area to be enclosed by the fence 10, with a post spacing that is adequate to impart strength to the fence 10 and to securely anchor other fence components. In the FIG. 1 embodiment, a post separation distance of 8 feet would be typical.

Each post 12 is preferably formed from a strong and durable material, such as sheet steel, aluminum or a plastic such as polyvinyl chloride. If metal, the post 12 is preferably formed from a metal sheet. In one preferred embodiment, the sheet has a thickness of 0.059 inches. In order to enhance its resistance to corrosion, this sheet is preferably subjected to a pre-galvanizing treatment. The pre-galvanized sheet is then subjected to a cold rolling process to form the rail into a tubular configuration, preferably having a rectangular cross-section. Alternately, the post may be formed with a circular cross-section. After cold rolling is complete, a polyester powder coating is preferably provided in order to further enhance corrosion resistance of the post 12.

With continued reference to FIG. 1, the fence 10 may be formed from a plurality of panels 16, each of which may function as a barrier. Preferably, panel 16 is modular in character. Each panel 16 is supported by, and extends between, an adjacent pair of posts 12, and is formed from at least one rail 18, and at least one upright member 20. More preferably, each panel 16 is formed from a plurality of spaced and parallel rails 18, and a plurality of spaced and parallel upright members 20, such as the pickets shown in FIG. 1. The upright members 20 forming each panel 16 preferably extend in substantially perpendicular relationship to the rails 18 forming that panel 16, subject to angular adjustment as described hereafter.

Figure 15:
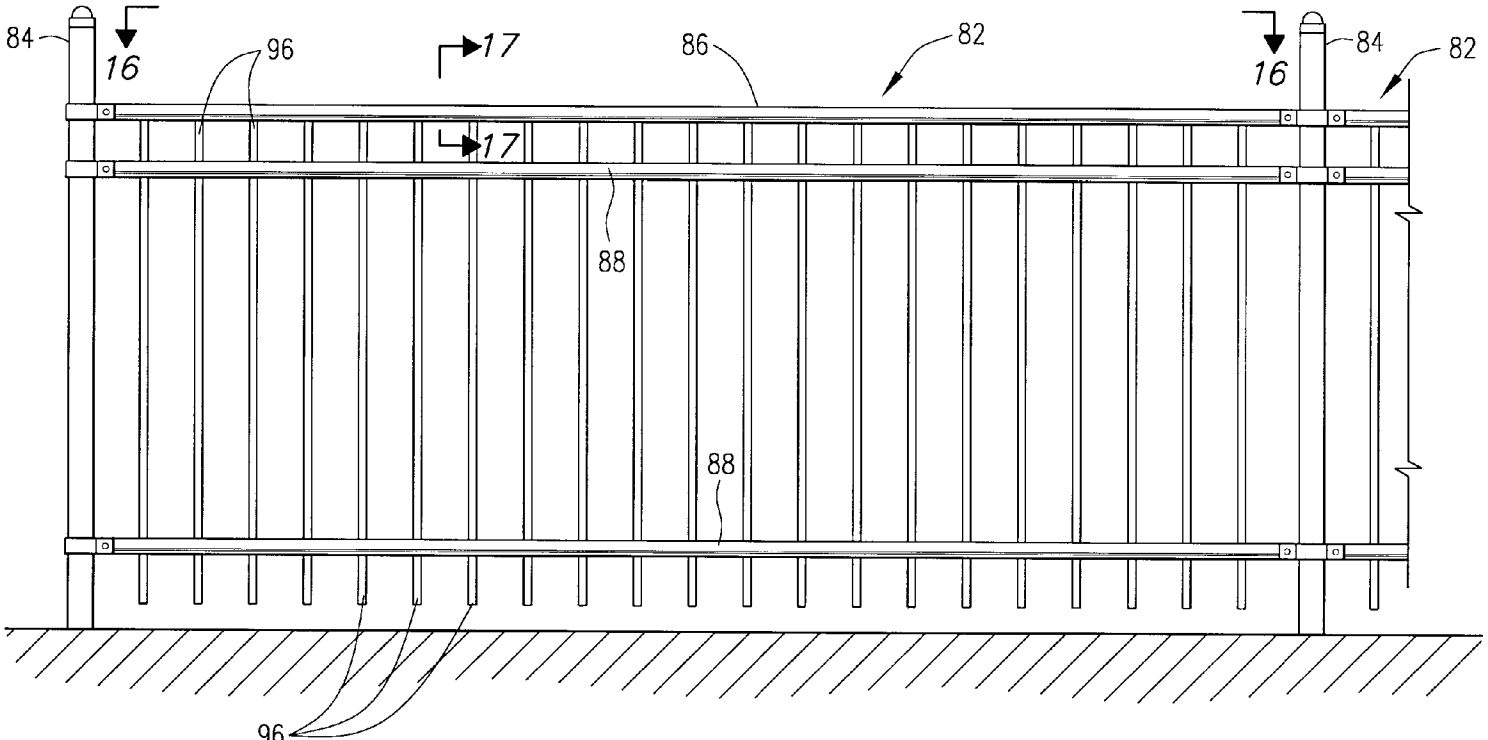
FIG. 15 is a front elevational view of a section of another type of fence embodying the present invention, showing a panel supported between a pair of adjacent posts. The supporting terrain is shown in cross section.

While any number of rails may be provided for each panel 16, either two rails, as shown in FIG. 1, or three rails, as shown in FIG. 15, are preferred. The number of upright members 20 provided for each panel 16 should be sufficiently great to assure that the separation distance between adjacent upright members 20, or between a post 12 and an adjacent upright member 20, will not permit an intruder to travel between them. For example, in a panel to be installed between posts, which are separated by an 8-foot distance, twenty-one upright members may be provided, with a uniform separation distance of 4.334 inches.

Figure 2:
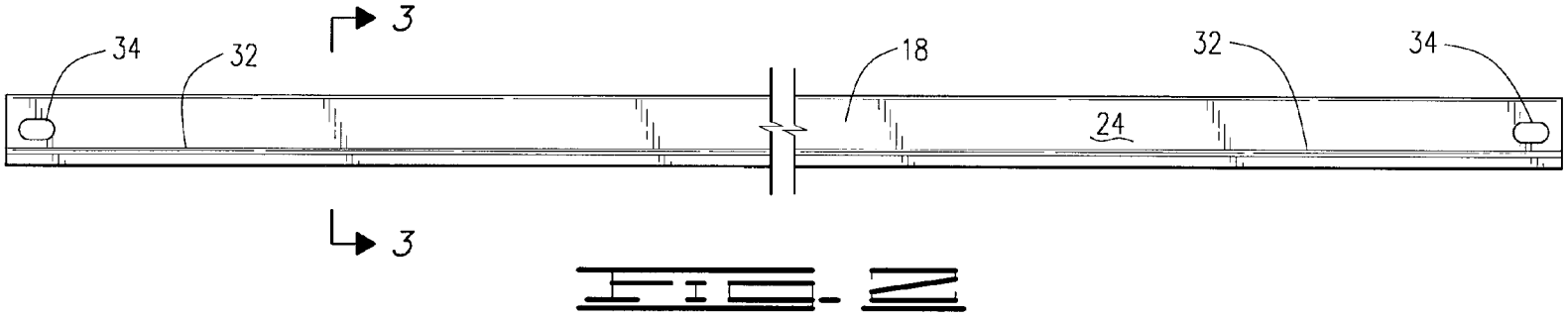
FIG. 2 is an enlarged and detailed front elevational view of one of the rails forming the panel shown in FIG. 1, prior to its assembly into the panel.
Figure 3:
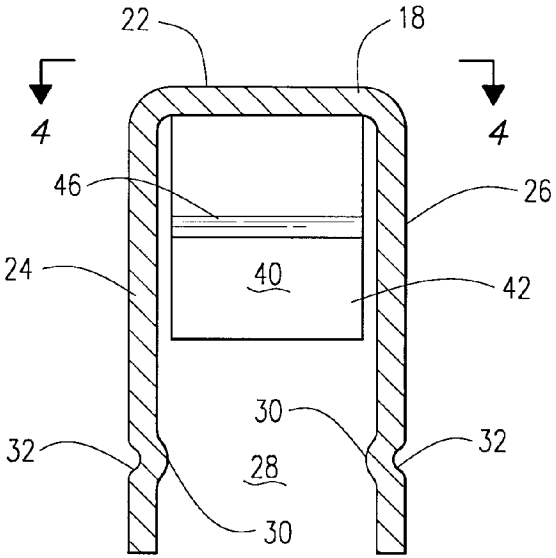
FIG. 3 is a cross-sectional view of the rail shown in FIG. 3, taken along line 3-3.
Figure 4:
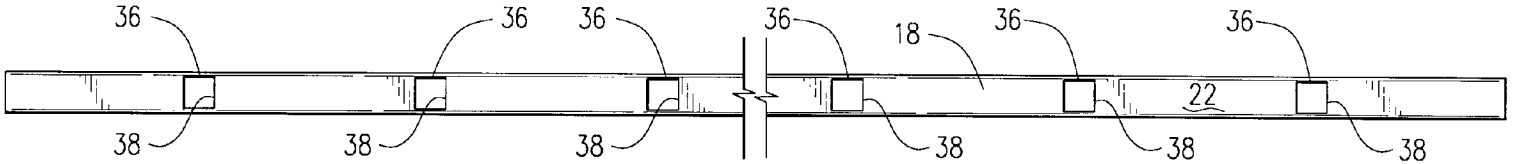
FIG. 4 is a top plan view of the rail shown in FIGS. 2 and 3, taken along line 4-4.

As best shown in FIGS. 2, 3 and 4, each rail 18 is characterized by an elongate web 22, which is preferably flat, and a pair of spaced and opposed side walls 24 and 26, which extend from the web 22, and preferably from the opposite lateral edges thereof. The web 22 and side walls 24 and 26 collectively define a U-shaped rail channel 28. The length of each rail 18 should be sufficient to fully span the distance between the adjacent of pair of posts 12 which will support that rail, or support the panel 16 into which the rail will be incorporated.

Each rail 18 is preferably formed from a strong and durable material, such as sheet steel, aluminum, or a plastic such as polyvinyl chloride. When the rail 18 is to be subjected to a resistance welding process, as described hereafter, the rail 18 should be formed from a conductive metal. If metal, the rail 18 is preferably formed from a metal sheet. In one preferred embodiment, the sheet has a thickness of 0.075 inches. In order to enhance its resistance to corrosion, this sheet is preferably subjected to a pre-galvanizing treatment. The pre-galvanized metal sheet is then subjected to a cold rolling process to produce the cross-sectional shape shown in FIG. 3.

Preferably at least one, and more preferably both, of the side walls 24 and 26 include a region 30 which projects within the rail channel 28. In the embodiment of the rail 18 shown in FIGS. 2, 3 and 4, a projecting region has been formed in each side wall. Each projecting region 30 may comprise, for example, a ridge that extends along at least a portion of its respective side wall, preferably longitudinally with respect to the rail, and more preferably in substantially parallel relationship to the longitudinal axis of the rail 18. Most preferably, each ridge extends continuously along substantially the entire length of its associated side wall.

When the rail 18 is formed from metal, and when the projecting regions comprise ridges, the ridges are preferably formed during the cold rolling process. One or more indentations 32, such as continuous longitudinal scores, are preferably formed in the surface of the sheet that will not define and be contiguous to the rail channel 28. These scores cause ridges to protrude from the opposite surface of the sheet. When that surface is formed into the rail channel 28 by the cold rolling process, each of the protrusions will define an elongate ridge which projects within the rail channel 28 and comprises a projecting region 30, as shown in FIG. 2.

When the rail 18 is formed from a sheet having a thickness of 0.075 inches, a preferred height for the region 30, with respect to its associated side wall, is 0.035 inches. A preferred width for the region 30 is 0.143 inches. A pointed and or angular profile for the region 30 is preferred.

In U.S. patent application Ser. No. 10/140,915, filed May 15, 2002, now U.S. Pat. No. 6,811,145, the entire disclosure of which is incorporated by reference, the projecting regions 30 of the rail described therein function as weld-forming regions. While the projecting regions 30 may perform a similar function in the present invention, it is also contemplated that resistance welds will not be formed at projecting regions 30 in some embodiments of the invention. Even when not used to form a weld, the score or other indentations 32 formed on the side wall surface opposite the projecting regions 30 functions to impart enhanced strength for the rail 18.

Opposed and aligned fastener openings 34 are formed at each of the side walls 24 and 26, preferably at each of the opposite ends of the rail 18. As shown in FIG. 4, a plurality of longitudinally spaced top openings 36 are preferably also formed in the web 22 of at least one of the rails 18, more preferably in all of the rails 18, with the possible exception of the uppermost rail 18. In the embodiment shown in FIGS. 1-4, top openings 36 are formed in all of the rails 18. Preferably, the fastener openings 34 and top openings 36 are formed by punching the sheet used to form the rail 18, before that sheet undergoes the cold rolling process used to form the rail 18. The top openings 36 should be characterized by identical size and shape, which preferably is rectangular. Each top opening should be characterized by at least one rectilinear edge. Other features of the structure and formation of the top openings 36 will described hereafter.

Each upright member 20 is preferably formed from a strong and durable material, such as sheet steel, aluminum or a plastic such as polyvinyl chloride. When the upright member 20 is to be subjected to a resistance welding process, as described hereafter, the upright member 20 should be formed from a conductive metal. If metal, the upright member 20 is preferably formed from a metal sheet. In one preferred embodiment, the sheet has a thickness of 0.040 inches. In order to enhance its resistance to corrosion, this sheet is preferably subjected to a pre-galvanizing treatment. The pre-galvanized sheet is then subjected to a cold rolling process to form the upright member into a tubular configuration, preferably having a rectangular cross-section.

Each of the upright members 20 is preferably sized to be closely but clearingly received within the rail channel 28 of each rail 18, and to be clearingly received through any top openings 36 formed in any of the rails 18 to which it will be attached, as will be described in more detail hereafter. As shown in FIG. 1, the vertical height of each upright member 20 is preferably approximately equal to the above-ground vertical height of the posts 12. In the embodiment shown in FIG. 1, each upright member 20 is characterized by a substantially straight-line longitudinal axis. Alternately, each upright member may be characterized by a longitudinal axis having a lower portion that is straight, in the area of the point or points of attachment to the rail 18, and an upper portion that bends or curves away from the straight lower portion. When a plurality of upright members 20 is provided, they are preferably identical.

Figure 8:
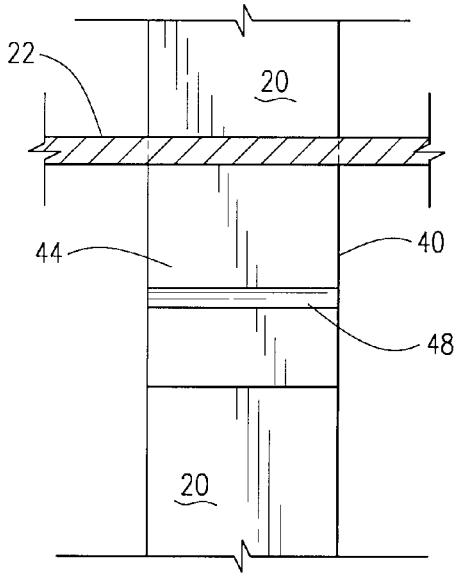
FIG. 8 is an enlarged top view of the rail and upright member shown in FIG. 7, taken along line 8-8.
Figure 8:
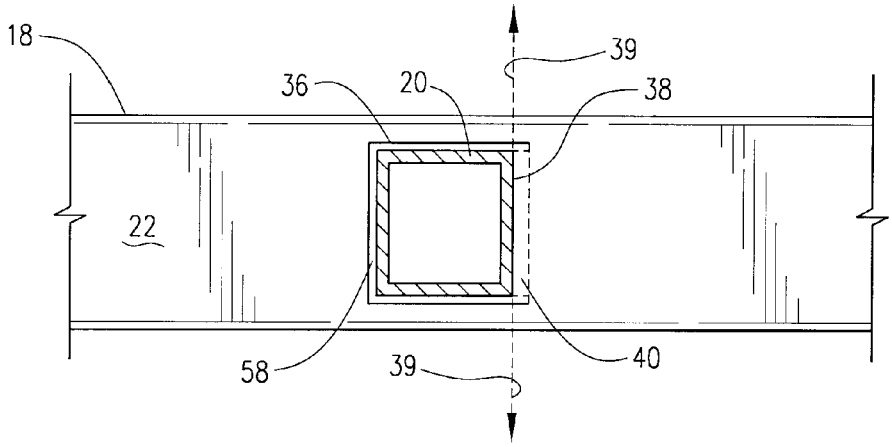

In the barrier of the present invention, each upright member 20 extends in transverse relationship to the rails 18 forming the barrier and traverses the rail channel 28 of each rail 18. Each upright member 20 is mechanically connected to each rail 18, such that the upright member 20 is selectively tiltable with respect to the rail 18 within an angular adjustment range. The angular adjustment range is preferably bilateral, extending on both sides of a transverse plane orthogonal to the rail 18. Relative tilting of each rail 18 and each upright member 20 preferably occurs around a rectilinear axis of rotation 39 which extends transversely to the rail 18 and is situated at or adjacent the web 22 at its point of contact with upright member 20. When the rail 18 includes top openings 36, this axis 39 preferably coincides with or is immediately adjacent to a rectilinear edge 38 of the opening 36 through which the upright member 20 extends, as shown in FIG. 8.

The mechanical connection between the rail 18 and upright member 20 may be formed by a weld, such as a resistance weld, by a permanent adhesive or by a fastener such as a bolt or screw. In the embodiment shown in FIGS. 1-10, the mechanical connection between each rail 18 and each upright member 20 is formed at a tab 40 of the rail 18. As best shown in FIGS. 3 and 4, a plurality of such tabs 40 are formed, in longitudinally spaced relationship, in each rail 18. Each tab 40 is preferably formed from the same material as the rest of the rail 18, and is characterized by a first surface 40 and an opposed second surface 42, both preferably substantially planar.

Each tab 40 extends from a position at or adjacent the web 22 of rail 18, and preferably depends into the rail channel 28. Each tab 40 is rotatable within the angular adjustment range about its upper edge, which joins or adjoins the web 22. When an upright member 20 is mechanically connected to tab 40, the upper edge of tab 40 coincides with rotational axis 39, about which the upright member 20 and rail 18 may be relatively tilted. The upper edges of adjacent tabs 40 in a given rail 18, and thus the rotational axes 39, should be parallel.

If the web 22 of the rail includes a plurality of longitudinally spaced top openings 36, each tab 40 is preferably situated adjacent a corresponding top opening 36, in a one-to-one relationship, with a single tab 40 provided for each top opening 36. The first surface 42 of each tab 40 should be situated adjacent the top opening 36, so the first surface 42 can contact an upright member 20 received through that top opening 36. In such an embodiment, each tab 40 preferably depends from a position at or adjacent a rectilinear edge 38 of the opening 36. As shown in FIG. 4, the tab 40 associated with each respective opening 36 should extend from the same relative side thereof, at rectilinear edge 38. This edge 38 should coincide with or closely adjoin the rotational axis 39 of the tab 40. In one preferred embodiment, the web 22 and the tabs 40 are integral, and the junction between each tab 40 and the web 22 comprises a bend in the material from which the rail 18 is formed.

The first surface 42 of each tab 40 is joined to its associated upright member 20, preferably with a weld, a permanent adhesive, such as an epoxy resin, or a fastener such as a bolt or screw. One preferred form of weld is a resistance weld. In order to form a resistance weld, the first surface of 42 of each tab 40 preferably is provided with a weldable projection 46, which functions as a weld-forming region. The projection 46 is preferably characterized by an axis that extends in orthogonal relationship to the tab 40. The cross-sectional profile, width and height of the weldable projection 46 are preferably the same as described with reference to projection 30.

The projection 46 may comprise one or more ridges situated on the tab 40, and more preferably comprises a ridge or ridges which extend continuously and along substantially the entire width of the tab 40, as shown in FIG. 3. Preferably, the ridge or ridges are oriented in substantially parallel relationship to the web 22. In alternative embodiments (not shown) the ridge or ridges may extend in parallel relationship to the side walls 24 and 26.

The tabs 40 and projections 46 are preferably formed while the metal used to form the rail 18 is a flat sheet. Three of the four sides of each top opening are cut through the flat sheet with a punch press or other tool. The projections 46 are preferably produced by forming one or more indentations 48 in that portion of the flat sheet within the rectangular region bounded by the three cuts, on the side thereof that will become the second surface 44. These indentations 48 cause a projection 46 to protrude from the opposite side of the sheet, in that portion thereof which will become the first surface 42 of tab 40.

Figure 6:
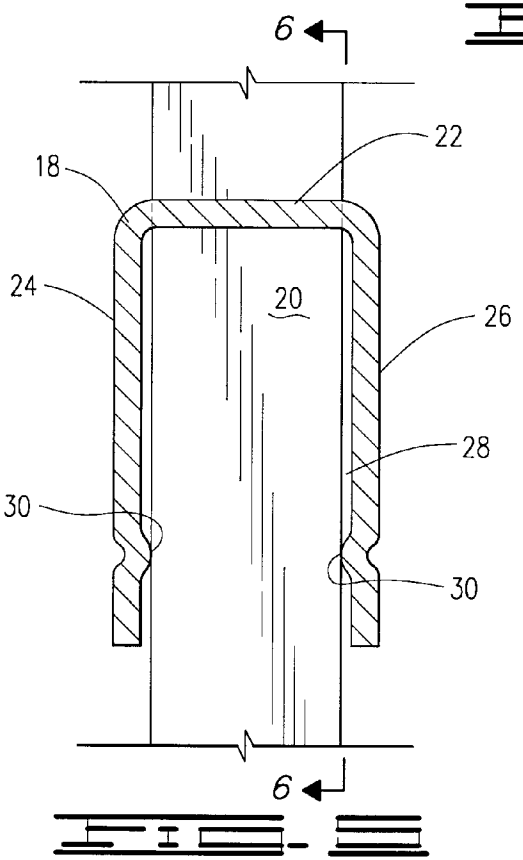
FIG. 6 is a cross-sectional view of the rail and upright member shown in FIG. 5, taken along line 6-6.

After forming the cuts and indentations, cold-forming is preferably used to shape the flat sheet into the U-shaped rail configuration shown in FIGS. 2 and 3. Finally, a press or other tool is used to bend down a tab 40 into the rail channel 28 at each location on the web 22 where U-shaped cuts have been formed. These bending steps produce a series of top openings 36 in the web 22, and position the tabs 40 within rail channel 28. As shown in FIG. 6, indentation 48 is positioned on the second surface 44 of tab 40 immediately opposite projection 46 formed in the first surface 42. The indentation 48 should have a profile complementary to that of projection 46. At least initially, each tab 40 should extend in substantially perpendicular relationship to the web 22, as shown in FIG. 6.

Figure 5:
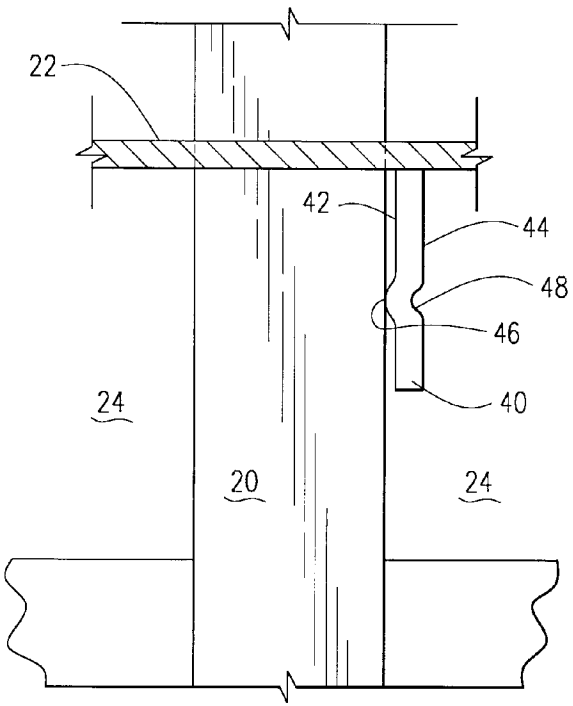
FIG. 5 is a cross-sectional view of the rail and upright member of the fence shown in FIG. 2 in a partially assembled state, prior to welding.

An upright member 20 is secured to a rail 18 by transversely positioning the upright member 20 within the rail channel 28, such that the upright member 20 is partially situated within the rail channel 28 in the desired position relative to the rail 18, as shown in FIGS. 5 and 6. In this position, the upright member 20 will ordinarily extend longitudinally in substantially perpendicular relationship to the rail 18, and should fully traverse the rail channel 28. While positioned within the rail channel 28 as described above, the upright member 20 should contact the projection 46 formed in the tab 40.

In the next stage of assembly, the upright member 20 is contacted with a first electrode (not shown) having a first polarity, and the rail 18 is contacted with a second electrode (not shown) having a second polarity opposed to the first polarity. Preferably, the point of contact for each electrode is near the projection 46. A welding current is then transmitted between the rail-contacting electrode and the upright member-contacting electrode.

Figure 7:
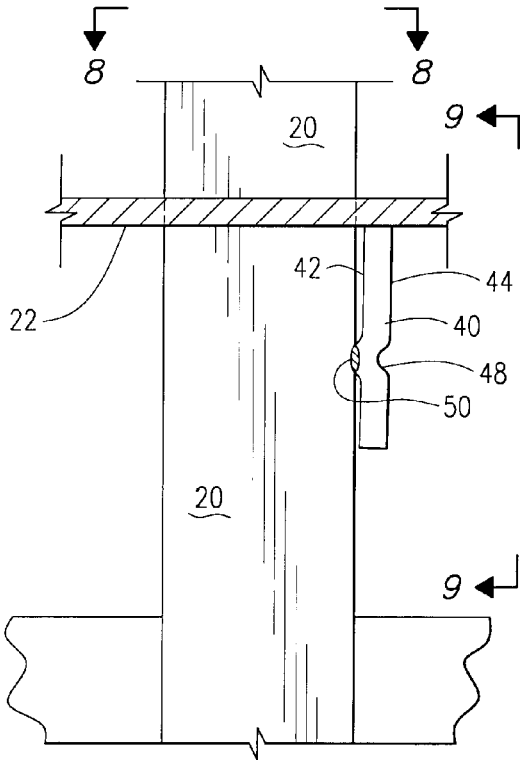
FIG. 7 is a cross-sectional view of the rail and upright member shown in FIG. 6, in assembled form after welding has taken place.

The welding current is of sufficient of magnitude, and applied for sufficient time, so that the electrical resistance of the rail 18 causes each of the projections 46 contacting the upright member 20 to heat up and at least partially melt. Current flow is then terminated, and the melted portions of the projections cool to form welds 50, as shown in FIG. 7. Each of the resulting welds 50 is situated within the rail channel 28 and joins an upright member 20 to an associated tab 40, resulting in an upright member-rail assembly. As shown in FIGS. 7 and 8, indentation 48 in the second surface 44 in each tab 40 is situated immediately opposite a corresponding weld 50 at the first surface 42.

In order to enhance the strength of the welds, the rail 18 is preferably compressed during the periods of current flow and cooling, such that each of the projections 30 is pressed against upright member 20. The electrodes are preferably used to apply this compressive force to the rail 18. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. The entire disclosures of these applications are incorporated by reference.

The source of the welding current is preferably a direct current inverter power supply, such as the model IS-471B, manufactured by Unitek Myachi Corporation of Monrovia, Calif. Such a power supply converts commercial alternating current into a high frequency direct current that is fed via a transformer to electrodes in a welding head. In one embodiment, a weld current of 22,000 amperes and a frequency of 1000 Hertz is used to form the welds. Preferably 2 cycles of such a current is used to form each weld.

Additional rails 18 and upright members 20 may be attached to the welded upright member-rail assembly by repeating the steps described above, until a fence panel 16 has been formed. In each such instance, an upright member 20 will be transversely positioned within the rail channel 28 of the rail 18 to which it is to be secured, so that it contacts the projection 46 of the adjacent tab 40. The upright member 20 is contacted with an electrode having a first polarity, and the rail 18 is contacted with an electrode having a second polarity opposed to the first polarity, preferably at or near the tab 40. While the rail 18 is undergoing compression as described above, a welding current is transmitted between the two electrodes to cause the projection to form a weld 40 within the rail channel 28 which joins the upright member 20 to the rail 18 at tab 40. After each panel 16 is assembled as described, it is preferably provided with a polyester powder coating in order to enhance its resistance to corrosion.

The welding steps required to assemble a panel 16 from rails 18 and upright members 20 may be performed in succession, or some or all of these steps may be performed simultaneously, preferably using a separate pair of electrodes to form each weld. The welding steps required to form a panel 16 may advantageously be performed with automated equipment, such as a press-type welding machine. Such a welding machine may comprise one or more welding heads, each of which contains first and second electrodes that can respectively contact an upright member 20 and an associated rail 18, preferably at tab 40. While current flows between the first and second electrodes, the welding machine simultaneously pressurizes the joint between the upright member 20 and rail 18. When the head is retracted, the partially assembled panel may be repositioned, so that another weld or group of welds may be formed.

With the resistance projection welding assembly method of the present invention, the welds used to assemble each panel 16 are formed internally within the rail channels 28. The exterior surfaces of the panel 16 of the present invention accordingly do not display any of the visible blemishes and marks, which are characteristic of other assembly methods, such as those involving other types of welding.

As best shown in FIG. 1, when the panel 36 is installed as a fence 10, each rail 18 of the assembled fence 10 is supported at opposite ends by brackets 52 mounted on an adjacent pair of posts 12. Each bracket 52 includes fastener openings (not shown) that may be aligned with corresponding fastener openings 34 formed in each end of each rail 18. A fastener 54, such as a bolt or screw, is inserted through aligned openings and secured in place by a holder (not shown), such as a nut or collar. In order to maintain the rails 18 of adjacent panels in end-to-end alignment, more than one bracket 52 may be installed at same vertical position on the post 12.

Figure 10:
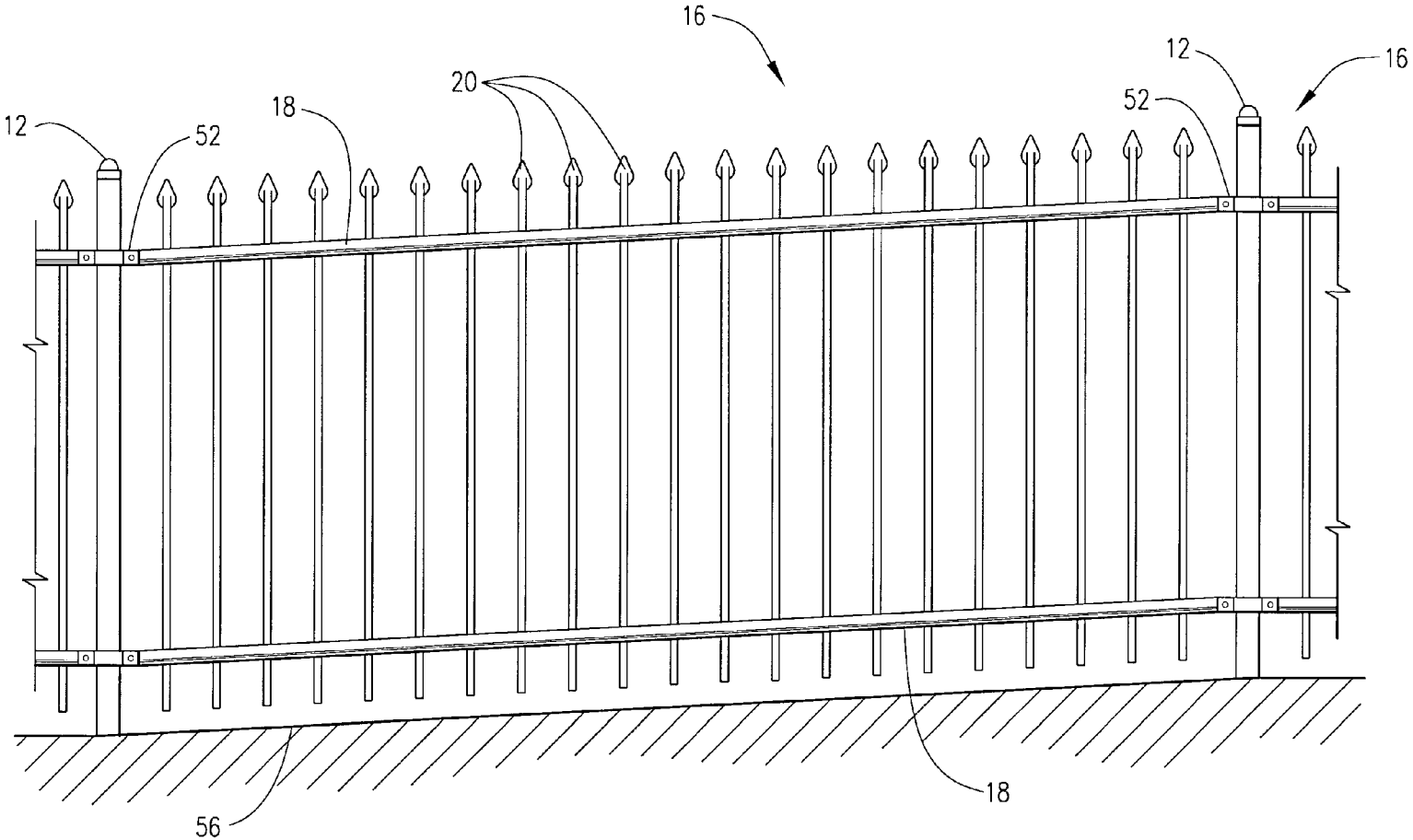
FIG. 10 is a front elevational view of showing the panel of FIG. 1 supported between a pair of adjacent posts in an installed position on a sloping terrain. The terrain is shown in cross section.
Figure 11:
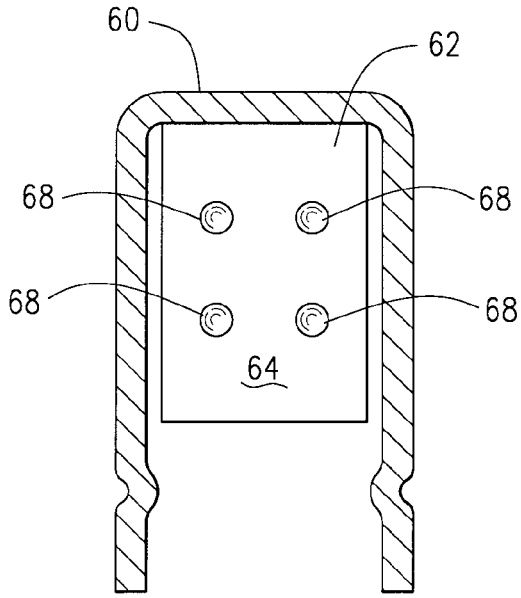
FIG. 11 is a cross-sectional view of another type of rail, prior to its assembly into a panel.

Within each panel 16, the incline of the rails 18 with respect to horizontal should substantially equal the incline of the terrain 56 on which pair of posts 12 supporting that panel are installed. Thus, when the fence 10 is positioned on horizontal terrain 56, as shown in FIG. 1, the rails 18 will be disposed substantially horizontally. If the terrain 56 is sloped, as shown in FIG. 10, the rails 18 should be oriented to follow that slope. Each set of brackets 52 should be oriented, as necessary, so as maintain its corresponding rail 18 in the required orientation. Each rail 18 is disposed such that the channels 28 open downwardly and the side walls 24 and 26 extend substantially vertically.

Figure 14:
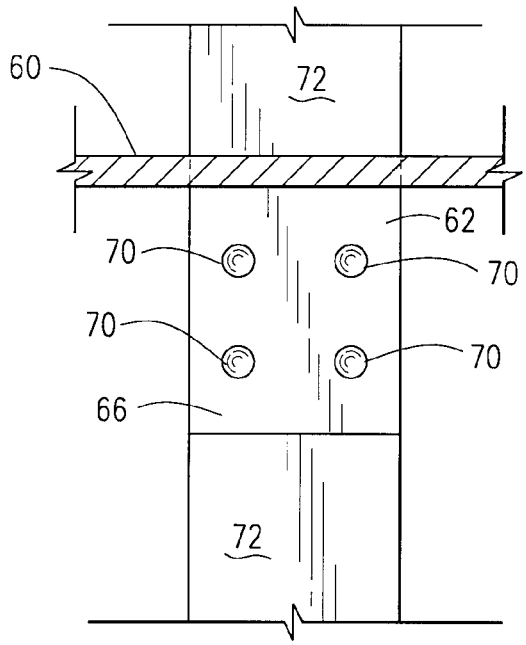
FIG. 14 is a cross-sectional side view of the rail and upright member shown in FIG. 13, taken along line 14-14.

Because top openings 36 are formed in each of the rails 18 comprising the panel 16 shown in FIGS. 1 and 14, each of the upright members 20 projects above the highest rail and below the lowest rail of the panel. The upper end of each upright member 20 may be formed into a pointed or sharpened configuration that will deter and hinder climbing, such as a spear or spike. Alternately, upright members 20 having round or flat tops may be used. The lower end of each upright member 20 is preferably situated no more than a small distance above the terrain 56 supporting the fence 10, in order to prevent an intruder from traversing the gap between the base of the upright member 20 and the terrain 56.

As shown in FIG. 8, each top opening 36 should be sized so that an area of clearance 58 exists between the top opening 36 and the upright member 20, on the side of the upright member opposite the tab 40. This area of clearance 58 permits the upright member 20 to tilt away from a perpendicular orientation with respect to rail 18. When the upright member 20 is tilted, the tab 40 welded to upright member 20 functions as a hinge, rotating at the junction of tab 40 and web 22, adjacent rectilinear edge 38. The longitudinal dimension of the area of clearance 58 should be sufficient to permit selective tilting of the upright member 20 in relation to rail 18 within an angular adjustment range. The longitudinal dimensions of the area of clearance 58 can also be limited so as to restrict this angular adjustment range.

Preferably, the upright member 20 is tiltable within an angular adjustment range of up to a maximum angle of at least about 10 degrees, and preferably up to a maximum angle of at least about 20 degrees, in at least one direction from a transverse plane orthogonal (perpendicular) to rail 18. More preferably, as noted above, the angular adjustment range is fully bilateral, permitting tilting within such an angle in either direction from this transverse plane. By selective tilting of the upright member 28 within this angular adjustment range, the upright members 20 may be adjusted to a vertical position, or a position parallel to the posts 12, when the fence is installed on a sloping terrain 56, as shown in FIG. 10.

One preferred embodiment of the present invention involves a rail 18 having a length of between about 92 and about 94 inches. A preferred angular adjustment range permits the associated upright members 20 to be adjusted to a vertical position when the rail 18 is positioned on a sloping surface with a vertical rise of up to about 30 inches between the opposite ends of the rail 18. This extent of relative tilting requires an angular adjustment range of between about zero degrees and at least about 18 to 20 degrees, in one and preferably both directions about the transverse plane.

One limitation of a barrier produced by a process like that described in U.S. patent application Ser. No. 10/140,915, filed May 7, 2002, is that the upright members or pickets are fixed in orientation with respect to the rail after the welding step is complete. The relative orientation of the welded pickets and rails, which is typically perpendicular, is maintained regardless of the slope upon which barrier is installed. For example, if such a barrier is installed on a 20 degree slope, the pickets of the barrier will not extend vertically, and will instead extend at a 20 degree angle to vertical. Such a picket configuration may be unacceptable from an aesthetic or functional standpoint.

In the present invention, on the other hand, the picket is tiltable with respect to the rail after mechanical connection between the rail and picket is formed, so that the picket can be tilted, if desired, with respect to the rail. If the barrier is installed on a slope, this feature will permit the pickets to be tilted to a vertical configuration, or a configuration parallel to posts 12, even though the rails of the barrier slope with respect to the horizontal in order to conform to the terrain.

In another embodiment of the invention, shown in FIGS. 11-14, a rail 60 is provided with a plurality of tabs 62, each having a first surface 64 and second surface 66. Except as noted below, the rails 68 and tabs 62, and their method of assembly with upright members into a panel or barrier, are identical to the rails 18 and tabs 40 described with reference to FIGS. 1-10.

In order to form a resistance weld, the first surface of 72 of each tab 62 preferably is provided with a weldable projection 68, which functions as a weld-forming region. The projection 68 preferably comprises at least one, and preferably a plurality of spaced compact, nipple-shaped projections. The cross-sectional profile of each of these projections 68, which are preferably axially symmetrical, may be the same as the cross-sectional profile of the projection 30. The preferred width, height and orientation of the projections 68 may be the same as described with reference to the projections 30. As shown in FIG. 14, an indentation 70, is formed the second surface 66 of tab 62, immediately opposite projection 68 formed in the first surface 64. The indentation 70 should have a profile complementary to that of projection 68 and preferably comprises one or more dimple-shaped depressions.

In one preferred embodiment, each individual projection 68 is characterized by an arcuate profile and a substantially circular lateral cross-section. Each such projection 68 has a maximum diameter at the planar portion of first surface 64 of about 0.18 inches. The maximum height of such a projection 68 above the planar portion of first surface 68 is about 0.048 inches. The preferred number of projections 68 for each tab 62 is four, each centered on a respective corner of a rectangle having sides of about 0.38 and about 0.25 inches. This rectangle is preferably oriented such that its longer side extends parallel to web of rail 60.

If the rail 60 is formed from metal, the only difference in the manufacturing process for the rail 60, as compared to the rail 18, is that no scores are impressed on the sheet during the cold rolling process, so that no ridges are formed within the rail channel. Instead, a plurality of longitudinally spaced dimple-shaped indentations 70 are formed on the sheet used to form the rail 60, on the side thereof, which will become the second surface 66. If the tab 62 includes more than one projection 68, then a set of spaced indentations 70 will be formed on the portion of each sheet that will be formed into a tab 62. Preferably, these indentations are formed before commencement of the cold rolling process.

The indentations 70 may be formed with a press punch or similar tool. These indentations 70 cause compact projections 68 to protrude from the opposite surface of the sheet. After the tabs 62 are formed, the projections 68 are situated on the first surface 64 and the indentations for formed on the second surface 66, as shown in FIG. 12.

Figure 12:
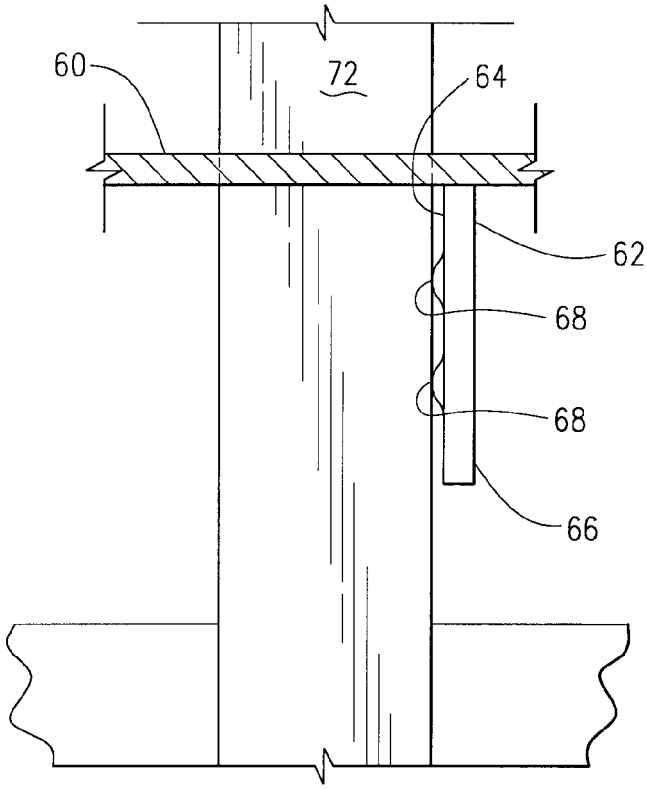
FIG. 12 is a cross-sectional view of the rail shown in FIG. 11 in a partially assembled state with an upright member, prior to welding.

An upright member 72 is secured to a rail 60 by transversely positioning the upright member 72 within the rail channel, such that the upright member 72 is partially situated within the rail channel in the desired position relative to the rail 60, as shown in FIG. 12. In this position, the upright member 72 will ordinarily extend longitudinally in substantially perpendicular relationship to the rail 60, and should fully traverse the rail channel 28. While positioned within the rail channel 28 as described above, the upright member 72 should contact the projection 68 formed in the tab 62.

In the next stage of assembly, the upright member 72 is contacted with a first electrode (not shown) having a first polarity, and the rail 60 is contacted with a second electrode (not shown) having a second polarity opposed to the first polarity. Preferably, the point of contact for each electrode is near the projection 68. A welding current is then transmitted between the rail-contacting electrode and the upright member-contacting electrode.

Figure 13:
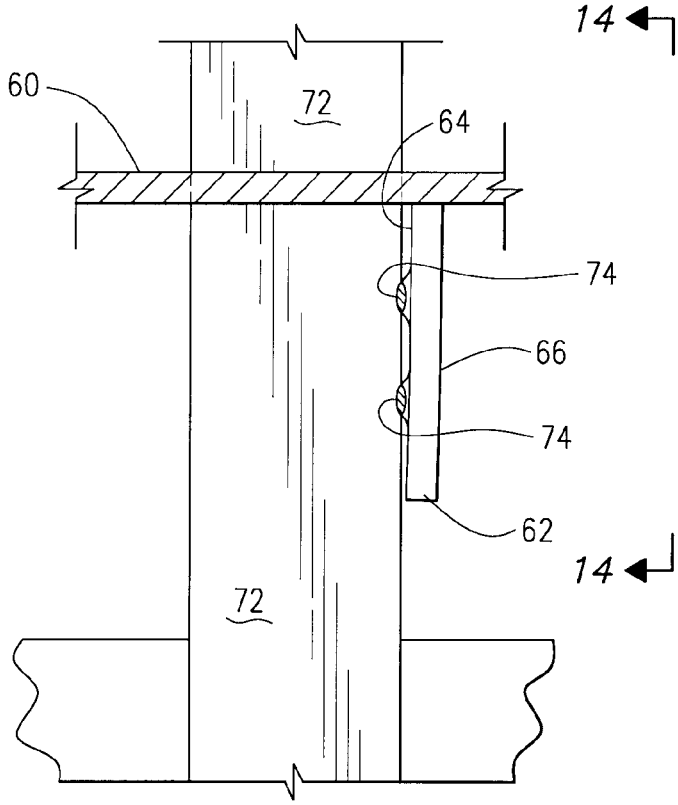
FIG. 13 is a cross-sectional view of the rail and upright member shown in FIG. 12, in assembled form after welding has taken place.

When current flow is terminated, the melted portions of the projections cool to form welds 74, as shown in FIG. 13. Each of the resulting welds 74 is situated within the rail channel 28 and joins an upright member 20 to an associated tab 62, resulting in an upright member-rail assembly. As shown in FIGS. 13 and 14, each indentation 70 in the second surface 66 of each tab 62 is situated immediately opposite a corresponding weld 74 at the first surface 64. Other features of the welding and assembly process of rails 68 and upright members 72 are identical to those described with reference to the embodiment of FIGS. 1-10. The installation of panels and barriers into which the rails 68 and upright members 72 are incorporated is likewise identical to that described with reference to FIGS. 1-10.

The embodiments shown in FIGS. 1-14 show a mechanical connection formed at a tab which depends within the rail channel. In an alternative embodiment, not shown in the Figures, a mechanical connection might be formed at a tab which projects from the side of the web opposite the rail channel. For example, in the embodiment of FIGS. 1-10, the tabs 40 may be bent upwardly from the web 22, away from the rail channel 28, rather than downwardly into the rail channel 28. Other features of this alternative embodiment are identical to those described with reference to FIGS. 1-14.

In the embodiment of FIGS. 1-14, the upright members 20 and 72 are shown as having a rectangular cross section. In other embodiments, not shown in the Figures, upright members having circular or diamond-shaped cross sections may be used. Such embodiments may be suited to use of a narrower tab than that shown in the Figures, preferably with a projection comprising one or more ridges extending in a generally vertical direction, parallel to the longitudinal axis of the upright member.

Figure 56:
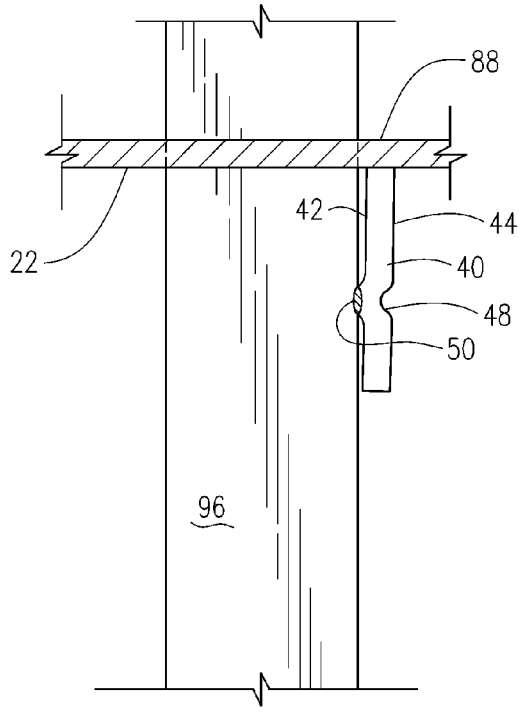
FIG. 56 is a cross-sectional viewing showing the connection of the upright member of the embodiments of FIGS. 15-17 to a tab of a lower rail.

FIG. 15 shows another embodiment of the barrier of the present invention, comprising a fence 80 formed from a plurality of modular panels 82, each of which is supported by, and extends between, an adjacent pair of posts 84. Each of the panels 82 are formed from at least three rails: an upper rail 86, and at least two lower rails 88. As shown in FIG. 56, the lower rails 88 are preferably identical to the rail 18 described with reference to embodiment of FIGS. 1-10, and are mechanically connected to the upright members 92 in the same manner described with reference to the embodiment of FIGS. 1-10.

Figure 16:
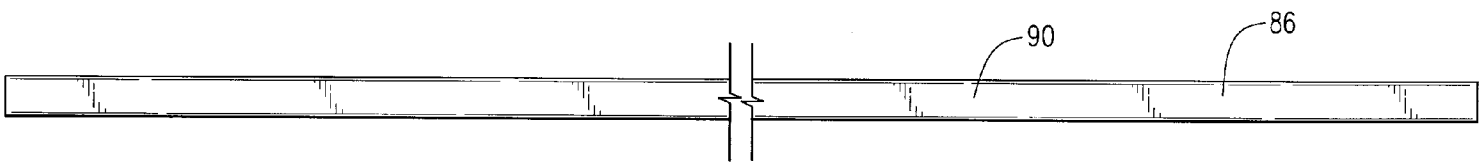
FIG. 16 is a top plan view of the upper rail of the panel shown in FIG. 15, taken along line 16-16.
Figure 17:
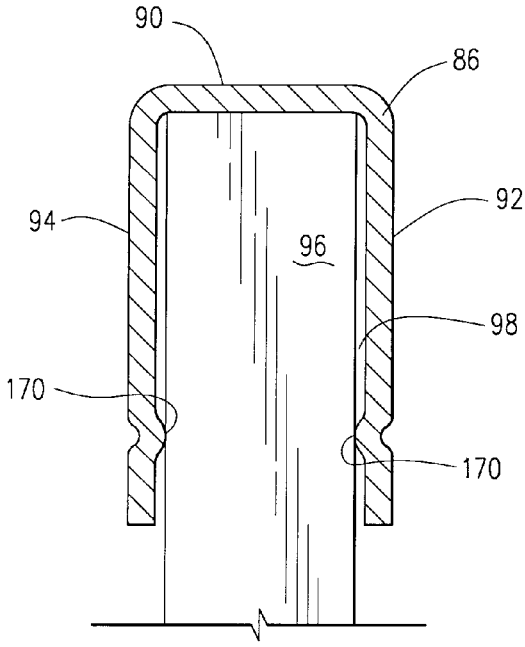
FIG. 17 is a cross-sectional view of the upper rail and upright member of the panel shown in FIG. 15, taken along line 17-17.

With reference to FIGS. 16 and 17, the upper rail 86 forming each panel 82 is identical to the lower rails 88, with a web 90 and spaced side walls 92 and 94, except that no openings are formed in its web 90. The upright members 96 forming each panel 82 accordingly cannot extend through the web 90 of the upper rail 86, and accordingly do not project above the upper rail 86, in contrast to the panel shown in FIG. 1. Instead, as shown in FIG. 17, each upright member 96 comprising the panel 82 terminates at its upper end within the rail channel 98 of the upper rail 86, preferably in abutment with the web 90.

Each upright member 96 is mechanically connected to the upper rail 86, such that the upright member 96 is selectively tiltable with respect to the upper rail 86 within an angular adjustment range. The absolute maximum adjustment angle within this range is preferably equal to that described with reference to the embodiment of FIGS. 1-14. While a fully bilateral angular adjustment range, like that described with reference to the embodiments shown in FIGS. 1-14, is possible, this bilateral range may not be provided in all embodiments. In such embodiments, a full range of angular adjustment may be available only on a single side of a transverse plane orthogonal to upper rail 86. In these embodiments, the maximum adjustment angle on the opposite side of the transverse plane may be smaller, or zero if the upright member 92 abuts the web 90 as shown in FIG. 17.

Relative tilting of each upper rail 86 and each upright member 96 preferably occurs around a rectilinear axis of rotation which extends transversely to the upper rail 86 and is situated at or adjacent the web 90 at its point of contact with upright member 96. The mechanical connection between each upright member 96 and upper rail 86 may be formed by a weld, such as a resistance weld, by a permanent adhesive or by a fastener such as a bolt or screw.

Figure 18:
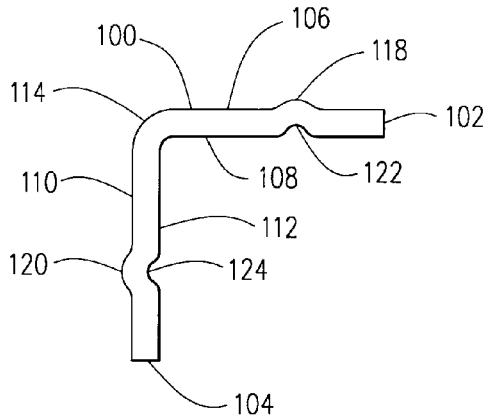
FIG. 18 is a side view of a bracket that may be used to form the panel shown in FIG. 15.

FIGS. 18-21 show a bracket 100 that may be used to form the mechanical connection between each upright member 96 and upper rail 86 in the panel 82 and fence 80 of the type shown in FIGS. 15-17. As best shown in FIG. 18, the bracket 100 comprises a L-shaped member, is preferably formed from the same material as the upper rail 86 and is characterized by the same thickness as the upper rail 86. The width of the bracket 100 should permit it to be clearingly inserted within the channel 98 of upper rail 86.

The bracket 100 comprises a brace section 102 and an adjacent tab section 104, each preferably substantially planar. The brace section 102 is characterized by opposed first and second surfaces 106 and 108, while the tab section 104 is characterized by opposed first and second surfaces 110 and 112. The brace and tab sections 102 and 104 are preferably oriented, at least initially, at a 90 degree angle.

The junction between brace and tab sections 102 and 104 should be rectilinear. Preferably the brace and tab sections 102 and 104 are integral, with the junction therebetween comprising a bend 114 in the material from which the bracket 100 is formed. As shown in FIG. 18, the second surfaces 108 and 112 are situated on the interior side of the angle formed by the bend 114, while the first surfaces 106 and 110 are situated on the exterior side of the same angle. The length of each section 102 and 104 preferably is substantially the same as the length of the tabs 40 of the rail 18 described with reference to FIGS. 1-10.

Figure 19:
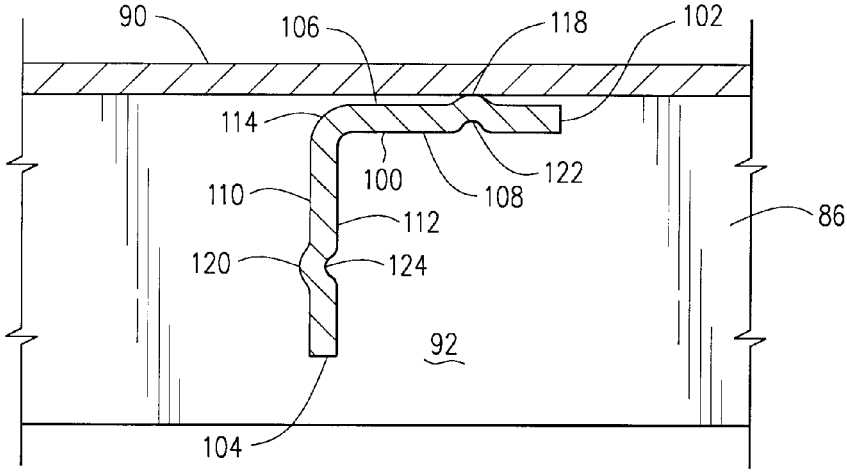
FIG. 19 is a cross-sectional view of the upper rail used to form the panel shown in FIG. 15, in a partially assembled state with the bracket of FIG. 18, prior to welding.

With reference to FIG. 19 the bracket 100 is inserted into the upper rail 86 such that the brace section 102 contacts the web 90 of upper rail 86, and such that the tab section 104 traverses the rail channel 98, in transverse relationship thereto. The bracket 100 is then mechanically secured to the rail 86, preferably at one or more connections formed between the brace section 102 and the web 90. The connections may be formed by a weld, by a permanent adhesive or by a fastener such as a bolt or screw. Preferably, the mechanical connections are formed by welds, and more preferably by resistance welds, as described hereafter.

Figure 20:
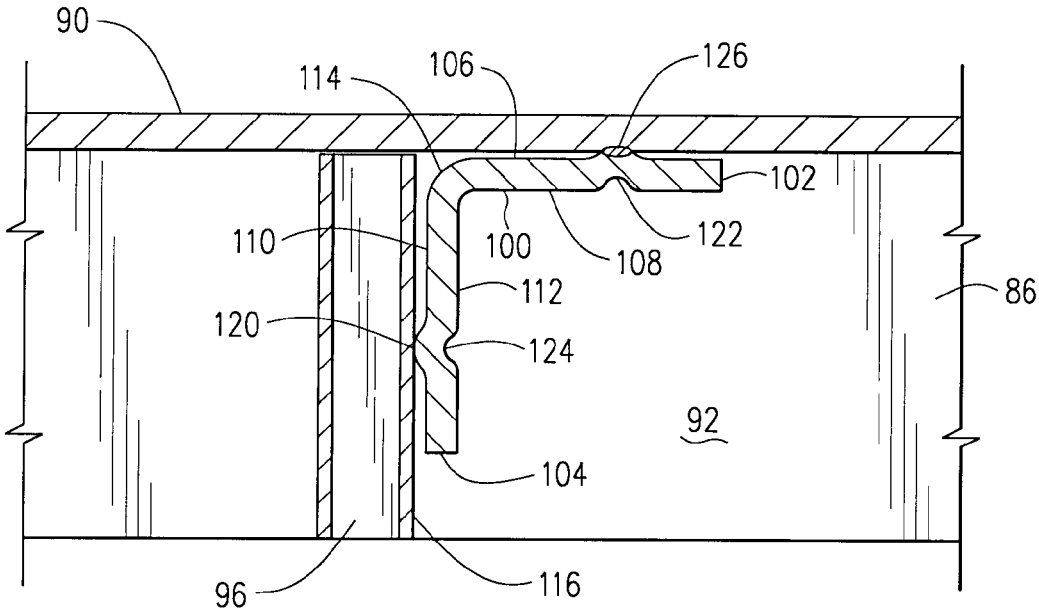
FIG. 20 is a cross-sectional view of the upper rail and bracket shown in FIG. 19, in a partially assembled state with an upright member. The bracket has been welded to the web of the upper rail, but has not yet been welded to the upright member.

After bracket 100 is installed in upper rail 86, an upright member 96 is inserted into the channel 98 of the upper rail 86, as shown in FIG. 20, such that its upper end abuts the web 90, and such that a side surface 116 contacts the second surface 112 of the tab section 104. The bracket 100 is then secured to the upright member 96 by means of a mechanical connection formed between side surface 116 and second surface 112 of tab section 104. The mechanical connection may be formed by one or more welds, by a permanent adhesive, or by one or more fasteners such as bolts or screws. Preferably, the mechanical connection is formed by one or more welds, and more preferably by resistance welds, as described hereafter.

After assembly with the upright member 96 and upper rail 86, the tab section 104 of bracket 100 may selectively tilted around the rectilinear bend 114, with the bend 114 functioning as a hinge. The upright member 96 which is secured to the tab section 104, is accordingly selectively tiltable with respect to the upper rail 86 within an angular adjustment range, which is preferably characterized by the same absolute maximum adjustment angle as that described with reference to the embodiment of FIGS. 1-14. This angular adjustment range extends on only a single side of a transverse plane orthogonal to the upper rail 86, such that the included angle between upright member 96 and upper rail 86 is 90 degrees or less. Relative tilting of the upper rail 86 and the upright member 96 occurs around a rectilinear rotational axis which coincides with the axis of bend 114, which is situated within the rail channel 98 adjacent the web 90. In the embodiment of FIGS. 18-21, no openings are formed in the web 90 adjacent any of the tab sections 104.

As discussed above, the mechanical connection between the bracket 100 and upper rail 86 and between bracket 100 and the upright member 96 each preferably comprises one or more resistance welds. In this embodiment, a first projection 118 is formed in the first surface 106 of brace section 102, and a second projection 120 is formed in the first surface 110 of tab section 104. The first and second projections 118 and 120 are preferably identical in size, shape, configuration and orientation to the projections 46 described with reference to the embodiment of FIGS. 1-10, or the projections 68 described with reference to the embodiment of FIGS. 11-14. The projections 118 and 120 may comprise one or more compact nipple-shaped projections, as in the embodiment shown in FIGS. 18-21, or may comprise one or more ridges (not shown).

As shown in FIGS. 18 and 19, a first indentation 122 is formed in second surface 108, immediately opposite the first projection 118, while a second indentation 124 is formed in second surface 112, immediately opposite the second projection 120. The first indentation 122 should have a profile complementary to that of first projection 118, while the second indentation 142 should have a profile complementary to that of second projection 120. Thus, if the projection comprises one or more compact projections, the indentation will comprise a corresponding number of dimple-shaped indentations. If the projection comprises one or more ridges, the indentation will comprise a corresponding number of scores.

With reference to FIG. 19, the bracket 100 is inserted into the upper rail 86 such that the first projection 118 contacts the web 90. The upper rail 86 is contacted with a first electrode (not shown) having a first polarity, and bracket 100 is contacted with a second electrode (not shown) having a second polarity opposed to the first polarity. Preferably, the point of contact for each electrode is near the first projection 118. A welding current is then transmitted between the rail-contacting electrode and the bracket-contacting electrode.

The welding current is of sufficient of magnitude, and applied for sufficient time, so that the electrical resistance of the bracket 100 causes the first projection 118 contacting the web 90 to heat up and at least partially melt. Current flow is then terminated, and the melted portions of the projection cool to form a weld 126, as shown in FIG. 20. The resulting weld 126 is situated within the rail channel 98 and joins the web 90 to bracket 100. The first indentation 122 is situated immediately opposite the weld 126.

In order to enhance the strength of the weld 126, the bracket 100 and/or the upper rail 86 are preferably compressed during the periods of current flow and cooling, such that each of the first projections 118 is pressed against web 90. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Other aspects of the welding process are identical to those described with reference of the embodiment of FIGS. 1-10. Additional brackets 100 may be attached to the web 90 by repeating the steps described above.

With continued reference to FIG. 20, an upright member 96 is inserted into the channel 98 of the upper rail 86, such that its upper end abuts the web 90, and one side of the upright member 96 contacts the second projection 120. The upright member 96 is contacted with a first electrode (not shown) having a first polarity, and bracket 100 is contacted with a second electrode (not shown) having a second polarity opposed to the first polarity. Preferably, the point of contact for each electrode is near the second projection 120. A welding current is then transmitted between the upright member-contacting electrode and the bracket-contacting electrode.

Figure 21:
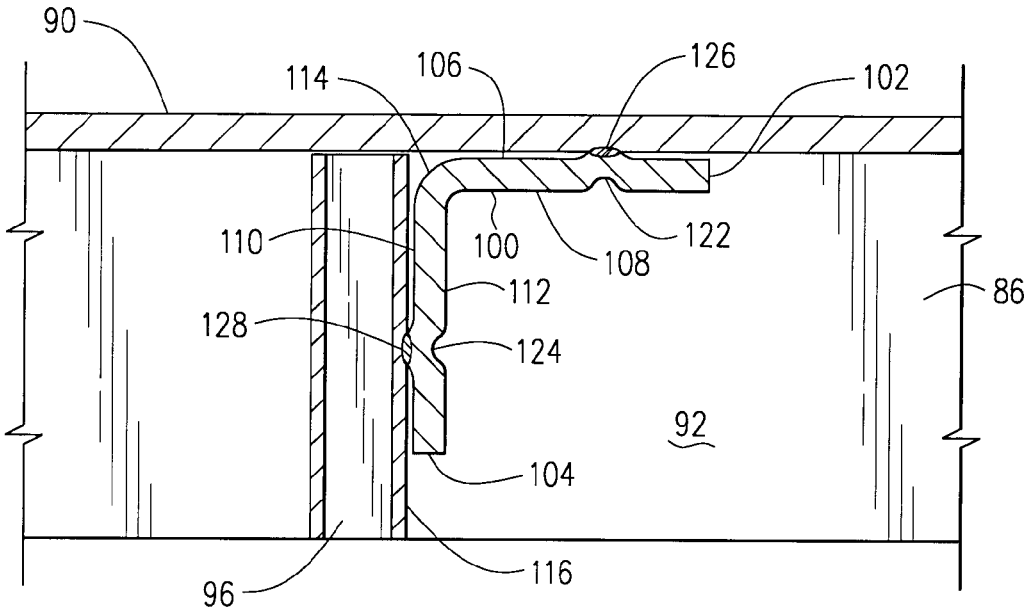
FIG. 21 is a cross-sectional view of the assembled upper rail, bracket and upright member shown in FIG. 20, after all welding has taken place.

The welding current is of sufficient of magnitude, and applied for sufficient time, so that the electrical resistance of the bracket 100 causes the second projection 120 contacting the upright member 96 to heat up and at least partially melt. Current flow is then terminated, and the melted portions of the projection cool to form a weld 128, as shown in FIG. 21. Each of the resulting welds 128 is situated within the rail channel 98 and joins an upright member 96 to a bracket 100.

In order to enhance the strength of the welds 128, the bracket 100 and/or the upright member 96 is preferably compressed during the periods of current flow and cooling, such that each of the second projections 120 is pressed against upright member 96. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Other aspects of the welding process are identical to those described with reference of the embodiment of FIGS. 1-10. Additional upright members 96 may be attached to additional brackets 100 by repeating the steps described above.

The welds 128 may be formed after formation of all of the welds 126 required to form a fence panel 82. Alternatively, some or all of the welds 126 and 128 may be formed simultaneously, or in alternation. Likewise, some or all of the welds 126 and 128 may be formed simultaneously with the welds required to secure the lower rails 88 to their respective upright members 96. Aside from the differences just noted, the components and methods of assembly and installation of a fence 80 and panel 82 using bracket 100 are identical to those described with reference to the embodiment of FIGS. 1-10.

Figure 22:
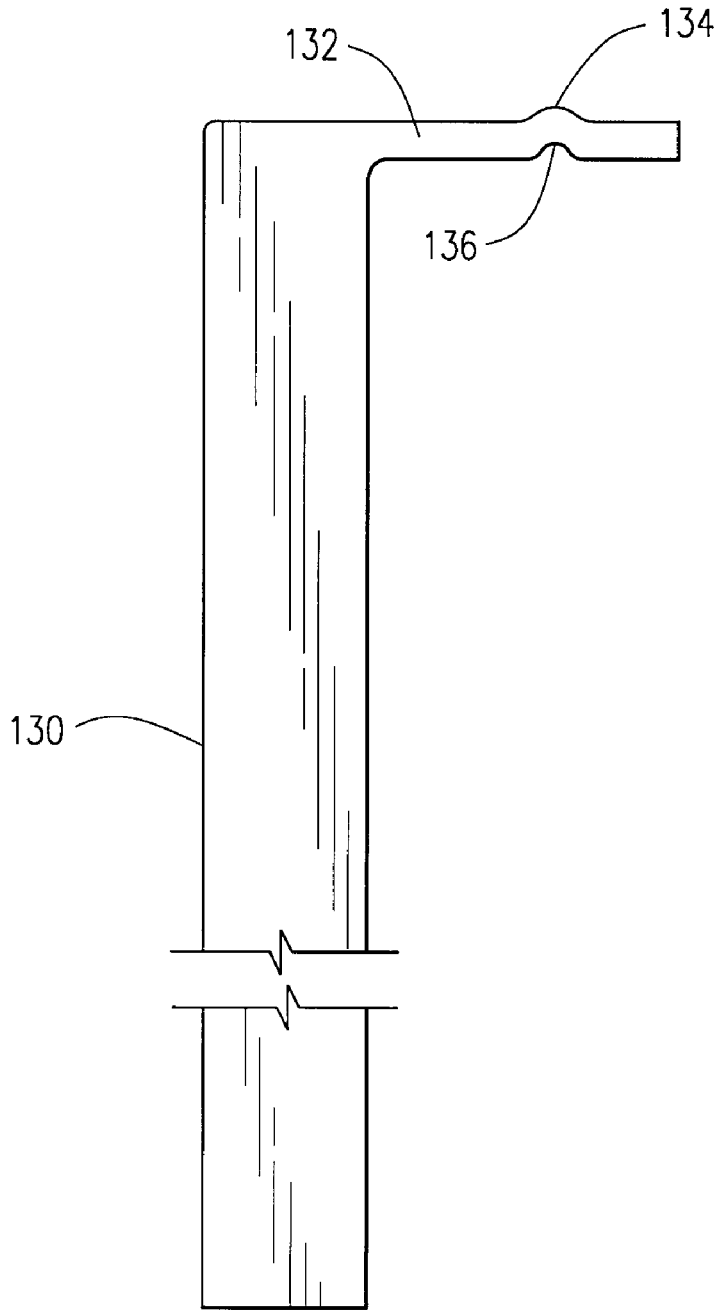
FIG. 22 shows another embodiment of upright member that may be used to form a panel like that shown in FIG. 15.

In another embodiment, a special upright member 130, shown in FIG. 22, is used in place of the bracket 100 and upright member 96 to form the panel 82 and fence 80 of the type shown in FIGS. 15-17. The upright member 130 features a laterally projecting tab 132, which is provided with a projection 134. An indentation 136 is formed immediately in tab 132 immediately opposite projection 134, on the opposite side therefrom. The indentation 136 should have a profile complementary to that of projection 134. The projecting tab 132 and projection 134 are preferably identical in size, configuration and orientation to the brace section 102 and first projection 118 of the bracket 100. Aside from the projecting tab 132, projection 134 and indentation 136, the upright member 130 is identical in construction to the upright member 20 described with reference to the embodiment of FIGS. 1-10.

Figure 57:
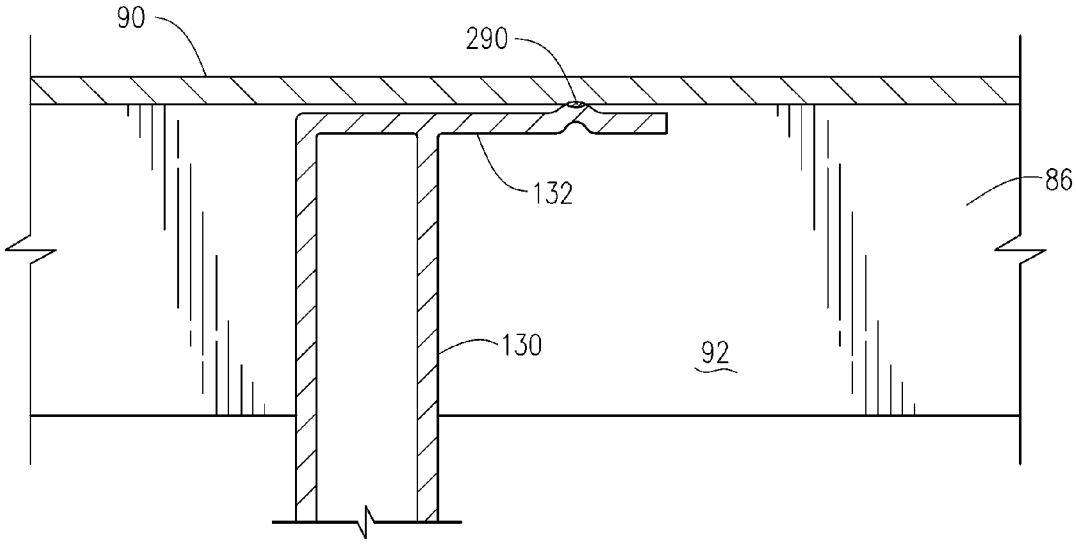
FIG. 57 is a cross-sectional view showing the upright member of FIG. 22 in an installed configuration within the upper rail.

As shown in FIG. 57, the upright member 130 is inserted into the channel of the upper rail 86, such that the projection 134 of the tab 132 contacts the web of 90 the upper rail 86. A welding current is applied, in essentially the same manner as described with reference to the embodiment described with reference to FIGS. 18-21, causing a weld 290 to form at the former site of projection 134. After welding is complete, the upright member 130 may be selectively tilted with respect to the upper rail within an angular adjustment range, with the rectilinear junction between the tab 132 and the body of upright member 130 serving as a hinge, and defining a rotational axis about which upright member 114 and the upper rail may be tilted. Aside from the differences just noted, a fence and panels employing the upright members 130, and its components and methods of assembly and installation, are identical to those described with reference to the embodiment of FIGS. 18-21.

The angular adjustment range is preferably characterized by the same absolute maximum adjustment angle as that described with reference to the embodiment of FIGS. 1-14. However, this angular adjustment range extends on only a single side of a transverse plane orthogonal to the upper rail, such that the included angle between the body of upright member 130 and the upper rail, and between the body of upright member 130 and tab 132, is 90 degrees or less.

FIGS. 24-31 show an alternative bracket 138 that may be used to form the mechanical connection between each upright member 96 and upper rail 86 in the panel 82 and fence 80 of the type shown in FIGS. 15-17. The bracket 138 is preferably formed from the same material as the upper rail 86, and is preferably characterized by the same thickness as the upper rail 86. The width of the bracket 138 should permit it to be clearingly inserted within the channel 98 of the upper rail 86.

Figure 24:
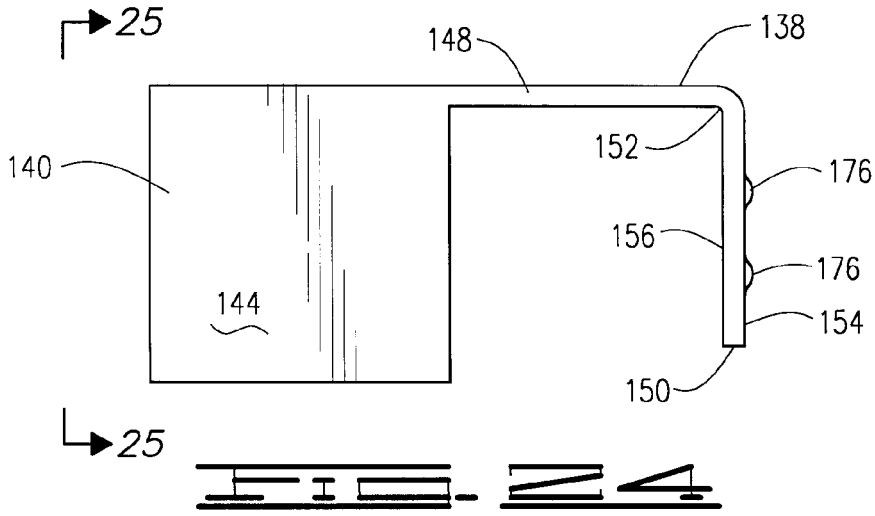
FIG. 24 is a front elevational view of the bracket shown in FIG. 23, in its fully formed state after folding.
Figure 25:
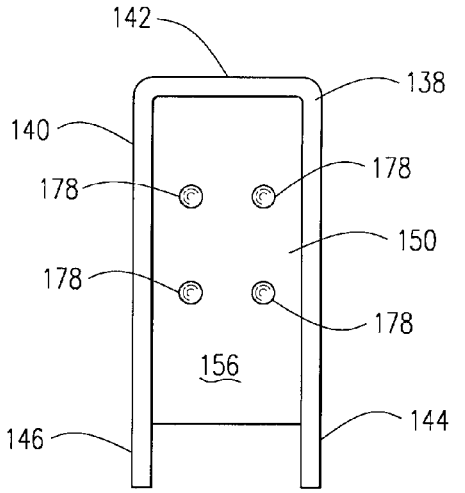
FIG. 25 is a side view of the bracket shown in FIG. 24, taken along line 25-25.

As best shown in FIGS. 24 and 25, the bracket 138 comprises a U-shaped brace section 140 characterized by a web 142, which is preferably flat, and a pair of spaced and opposed side walls 144 and 146 which extend from opposite edges of the web 142. A spacer section 148 projects from one end of the web 142, preferably in coplanar relationship thereto. Preferably the brace and spacer sections 140 and 148 are integral. A tab section 150, preferably substantially planar, depends from the end of the spacer section 148 most distant from the brace section 140. The junction between the tab section 150 and the spacer section 148 should be rectilinear. The spacer and tab sections 148 and 150 are likewise preferably integral, with the junction therebetween comprising a bend 152 in the material from which the bracket 138 is formed. The tab section 150 is characterized by opposed first and second surfaces 154 and 156. The first surface 154 faces away from the brace section 126, while the second surface 156 faces toward the brace section 140. The width of tab section 150 preferably equals the spacing of side walls 144 and 146, while the height of the tab section 150 is preferably no greater, and more preferably somewhat less than the height of side walls 144 and 146.

Figure 23:
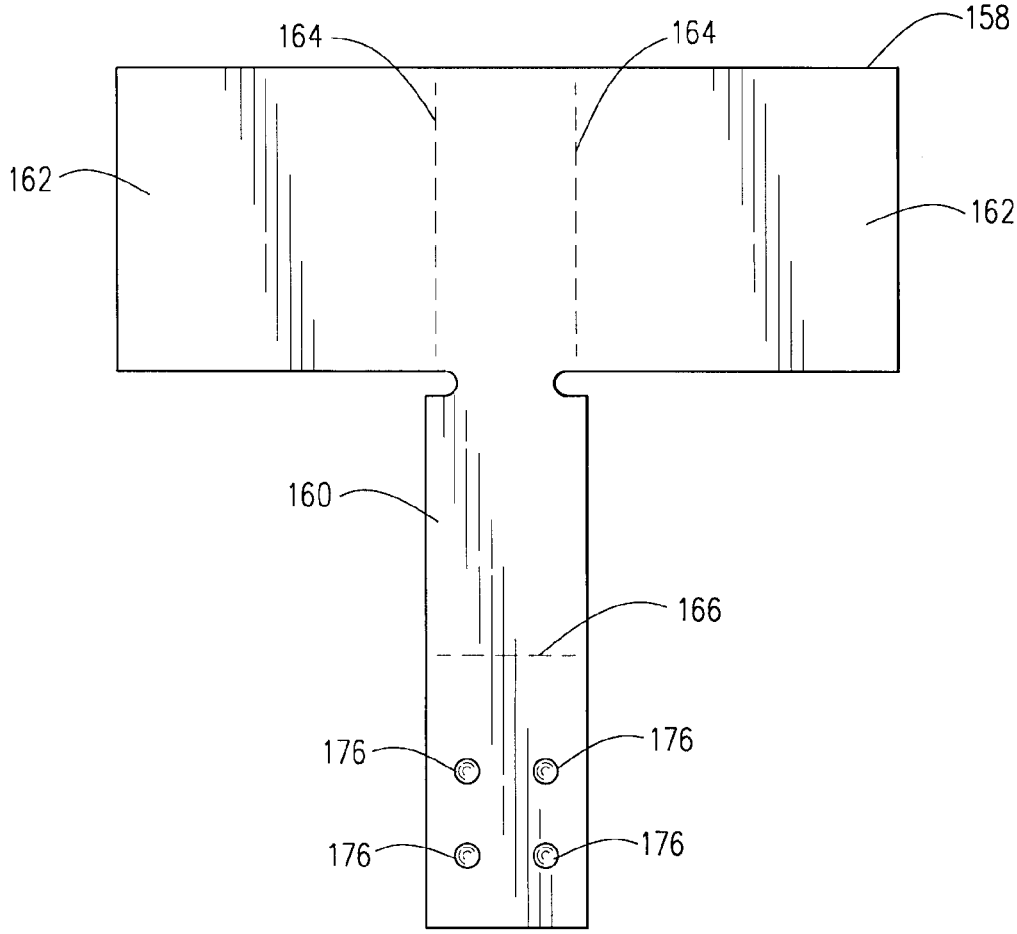
FIG. 23 is a plan view of another embodiment of a bracket which be used to form a panel like that shown in FIG. 15. The bracket is shown in a partially formed state, prior to folding.

As illustrated in FIG. 23, the bracket 138 is preferably formed from a single T-shaped planar sheet 158 having a stem section 160 and a cross section 162. The opposite sides of the cross section 162 are bent at 90 degree angles to the sheet 158 along parallel lines 164, to form the side walls 144 and 146. A press or other tool is used to form these bends. The area between the parallel lines 164 forms the web 142. The end of stem section 160 most remote from the cross section is bent, with a press or other tool, along line 166 that is preferably perpendicular to the lines 164. The end of stem section 160 should be bent in the same direction as the opposite ends of the cross section 162. At least initially, the end stem section should be bent at a 90 degree angle with respect to sheet 158. The bent end of the stem section 160 forms the tab section 150, while the balance of the stem section 160 forms the spacer section 148.

In an embodiment not shown in the Figures, a rib, comprising an elongate and continuous depression in the planar surface shown in FIG. 3, is formed in stem section 160 and 162. The rib should extend parallel to stem section 160, and extend across at least a portion of the web 142 and spacer section 148 of the assembled bracket 138. The rib, which is preferably formed in sheet 158 prior to its bending into bracket 138, may be produced by a press or other tool. The rib stiffens the spacer section 148, thereby enhancing the rotatability of tab section 150 about bend 152.

Figure 26:
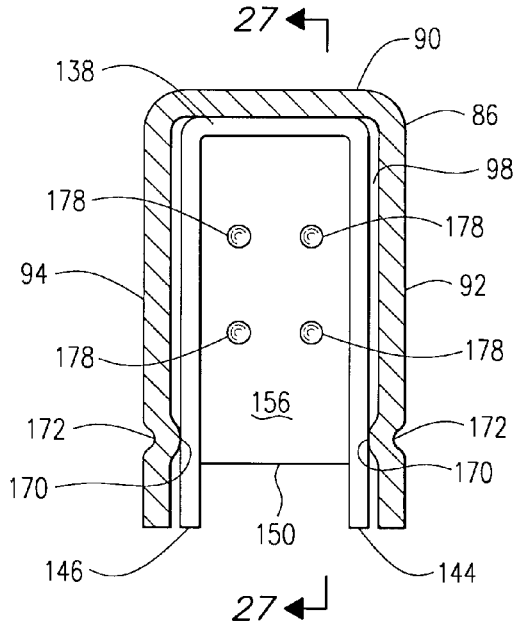
FIG. 26 is a cross-sectional side view of an upper rail of a panel of the present invention, in a partially assembled state with the bracket of FIGS. 24 and 25, prior to welding of the bracket to the rail side walls.
Figure 27:
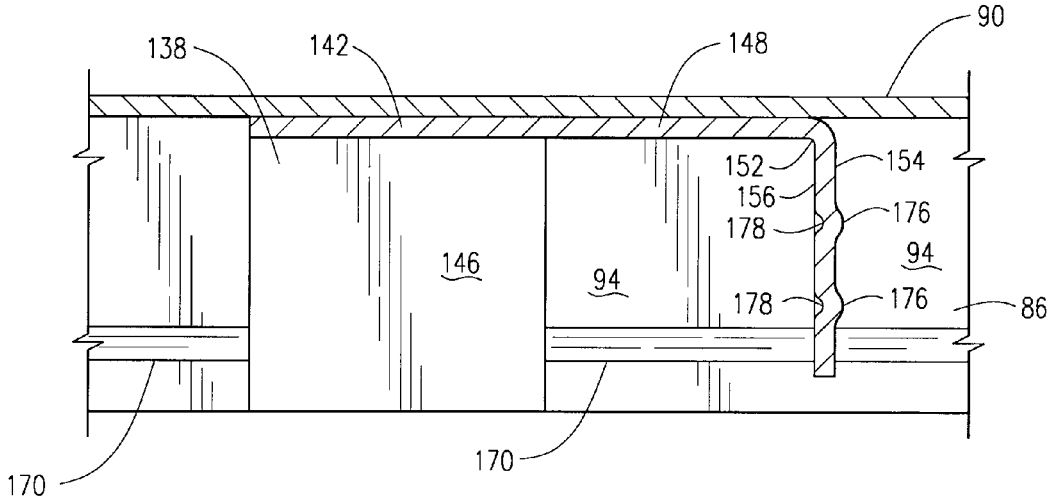
FIG. 27 is a front cross-sectional view of the partially assembled bracket and upper rail shown in FIG. 26, taken along line 27-27.

With reference to FIGS. 26 and 27, the bracket 138 is inserted into the upper rail 86 such that the web 160 and spacer section 148 contact the web 90 of upper rail 86, such that the side walls 144 and 146 of the bracket 138 respectively contact the spaced side walls 92 and 94 of upper rail 86, and such that the tab section 150 traverses the rail channel 92, in transverse relationship thereto. The bracket 138 is then mechanically secured to the rail 86 at brace section 140, preferably by connections formed between bracket side wall 144 and rail side wall 92, and between bracket side wall 146 and rail side wall 94. The connections may be formed by a weld, by a permanent adhesive or by a fastener such as a bolt or screw. Preferably, the mechanical connections are formed by welds, and more preferably by resistance welds, as described hereafter.

Figure 28:
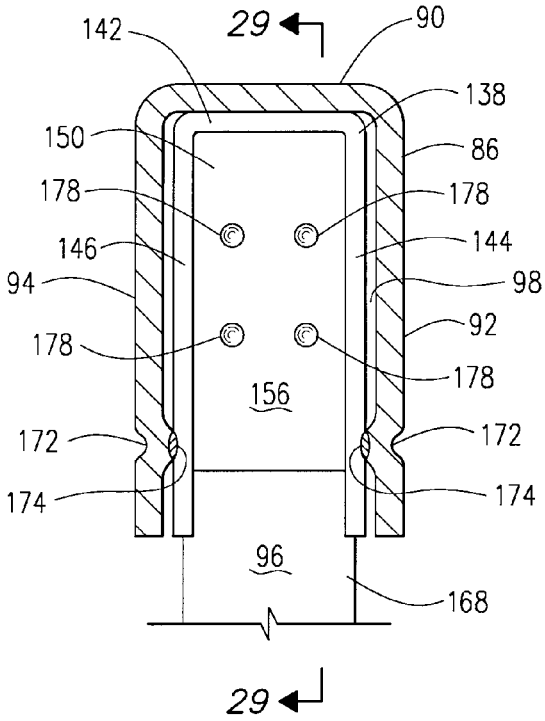
FIG. 28 is a cross-sectional side view of the upper rail of a panel and the bracket of FIG. 26, in a partially assembled state with an upright member. The bracket has been welded to side walls of the upper rail, but has not yet been welded to an upright member.
Figure 29:
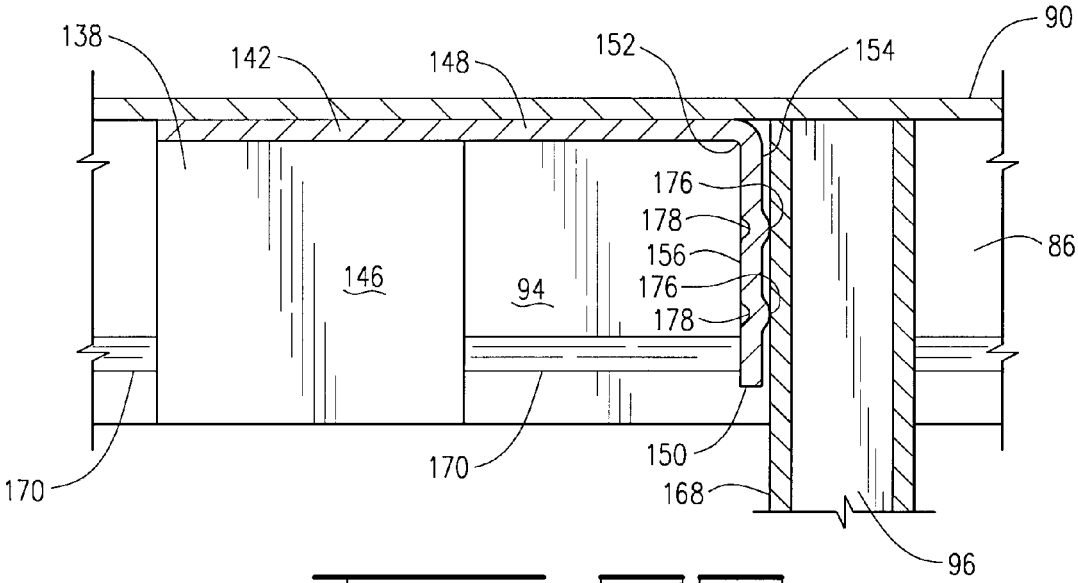
FIG. 29 is a front cross-sectional view of the upper rail, bracket and upright member shown in FIG. 28, taken along line 29-29. The bracket has been welded to the web of the upper rail, but has not yet been welded to the upright member.

After installation of the bracket 138 into the upper rail 86, an upright member 96 is inserted into the channel 98 of the upper rail 86, as shown in FIGS. 28 and 29, such that its upper end abuts the web 90, and such that the first surface 154 of the tab section 150 contacts a side surface 168 of the upright member 96. The bracket 138 is then mechanically secured to the upright member 96 at first surface 154 of tab section 150. The mechanical connection may be formed by one or more welds, by a permanent adhesive or by one or more fasteners such as bolts or screws. Preferably, the mechanical connection is formed by one or more welds, and more preferably by resistance welds, as described hereafter.

After assembly with the upright member 96 and upper rail 86, the tab section 150 of bracket 138 may selectively tilted around the rectilinear bend 152 formed at line 166 of sheet 158, with the bend 152 functioning as a hinge. The upright member 96 is accordingly selectively tiltable with respect to the upper rail 86 within an angular adjustment range, which is preferably characterized by the same absolute maximum adjustment angle as that described with reference to the embodiment of FIGS. 1-14. This angular adjustment range extends on only a single side of a transverse plane orthogonal to the upper rail 86, such that the included angle between upright member 96 and upper rail 86 is 90 degrees or less. Relative tilting of the upper rail 86 and the upright member 96 occurs around a rectilinear rotational axis which coincides with the axis of bend 152, which is situated within the rail channel 98 adjacent the web 90.

As noted above, the mechanical connection between the bracket 138 and the upper rail 86 preferably comprises one or more resistance welds. In this embodiment, a weldable projection 170 which projects within the rail channel 98 is formed on at least one and preferably both of the side walls 92 and 94, as shown in FIG. 26. The projections 170 are preferably identical in size, shape, configuration and orientation to the projecting weld-forming regions described in U.S. patent application Ser. No. 10/140,915, filed May 7, 2002. The projections 170 preferably comprise one or more ridges, as shown in FIG. 26, but may alternately comprise one or more compact nipple-shaped projections (not shown).

As shown in FIG. 26, indentations 172 are formed in the exterior surfaces of side walls 92 and 94, immediately opposite the corresponding projections 170 formed in the opposite surfaces of the side walls 92 and 94. Each indentation 172 should have a profile complementary to that of projection 170.

With reference to FIGS. 26 and 27, the bracket 138 is inserted into the upper rail 86 such that the projection 170 formed in rail side wall 92 contacts side wall 144, and the projection 170 formed in rail side wall 94 contacts side wall 146. The upper rail 86 is contacted with a first electrode (not shown) having a first polarity, and bracket 138 is contacted with a second electrode (not shown) having a second polarity opposed to the first polarity. Preferably, the point of contact for each electrode is near the projections 170. A welding current is then transmitted between the rail-contacting electrode and the bracket-contacting electrode.

The welding current is of sufficient of magnitude, and applied for sufficient time, so that the electrical resistance of the bracket 138 causes the projections 170 contacting each of the side walls 144 and 146 to heat up and at least partially melt. Current flow is then terminated, and the melted portions of each projection cool to form a weld 174, as shown in FIG. 28. The resulting welds 174 are situated within the rail channel 98 and join each side wall of the upper rail 86 to bracket 138. Indentation 172 is situated immediately opposite each weld 174.

In order to enhance the strength of the welds 174, the bracket 138 and/or the upper rail 86 is preferably compressed during the periods of current flow and cooling, such that each of the projections 170 is pressed against its corresponding side wall. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Additional brackets 138 may be attached to the upper rail 86 by repeating the steps described above.

In an alternative embodiment, not shown in the Figures, projections may be formed on the exterior side walls 144 and 146 of bracket 138, rather than on the side walls 92 and 94 of the upper rail 86. The size, shape and configuration the projections are identical to that of projections 170. Other details of the assembly process are identical to that described with reference to FIGS. 26-28.

As discussed above, the mechanical connection between the bracket 138 and the upright member 96 also preferably comprises one or more resistance welds. In this embodiment, a projection 176 is formed in the first surface 154 of tab section 150. The projection 176 is preferably identical in size, shape, configuration and orientation to the projections 46 described with reference to the embodiment of FIGS. 1-10, or the projections 68 described with reference to the embodiment of FIGS. 11-14. The projection 176 may comprise one or more compact nipple-shaped projections, such as plural spaced compact projections 176 shown in FIG. 24, or may comprise one or more ridges (not shown). As shown in FIG. 23, the projection 176 is preferably formed in sheet 140 by a punch press or other tool, prior to bending of the sheet 140 into the assembled bracket 138. As shown in FIGS. 24 and 25, an indentation 178 is formed in second surface 156, immediately opposite the projection 176. The indentation 178 should have a profile complementary to that of projection 176.

With reference to FIGS. 28 and 29, an upright member 96 is inserted into the channel 98 of the upper rail 86, such that its upper end abuts the web 90, and side surface 168 of the upright member 96 contacts the projection 176. The upright member 96 is contacted with a first electrode (not shown) having a first polarity, and bracket 138 is contacted with a second electrode (not shown) having a second polarity opposed to the first polarity. Preferably, the point of contact for each electrode is near the projection 176. A welding current is then transmitted between the upright member-contacting electrode and the bracket-contacting electrode.

Figure 30:
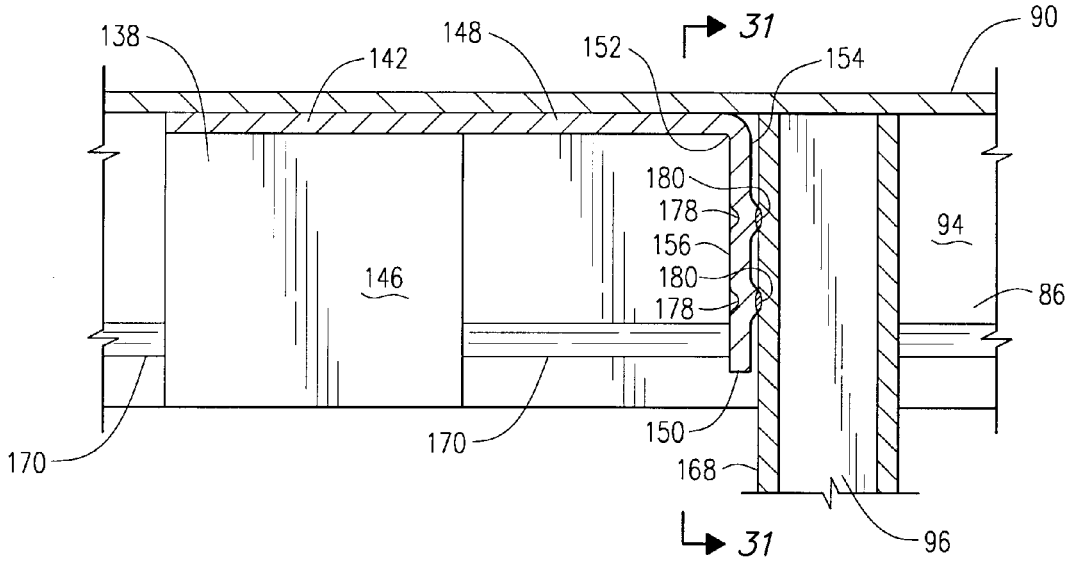
FIG. 30 is a front cross-sectional view of the upper rail, bracket and upright member shown in FIG. 29 in a fully assembled state, after all welding has taken place.
Figure 31:
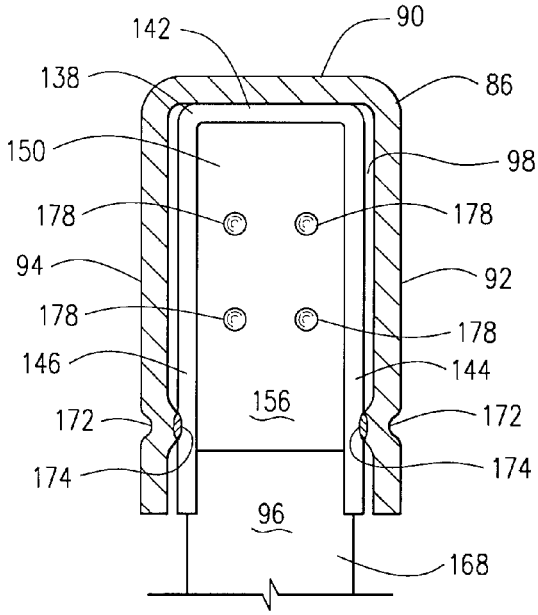
FIG. 31 is a side cross-sectional side view of the upper rail of a panel and the bracket of FIG. 30.
Figure 32:
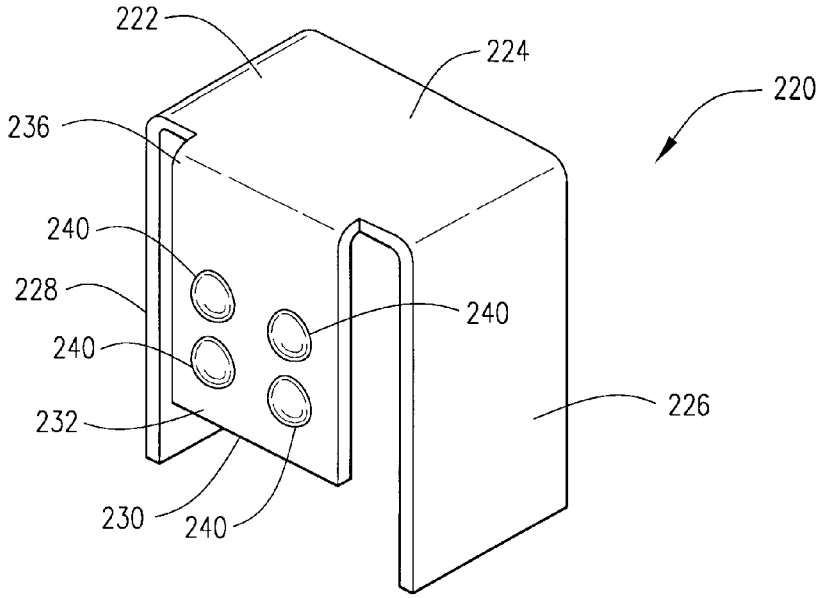
FIG. 32 is a perspective view of another embodiment of a bracket which be used to form a panel like that shown in FIG. 15.
Figure 33:
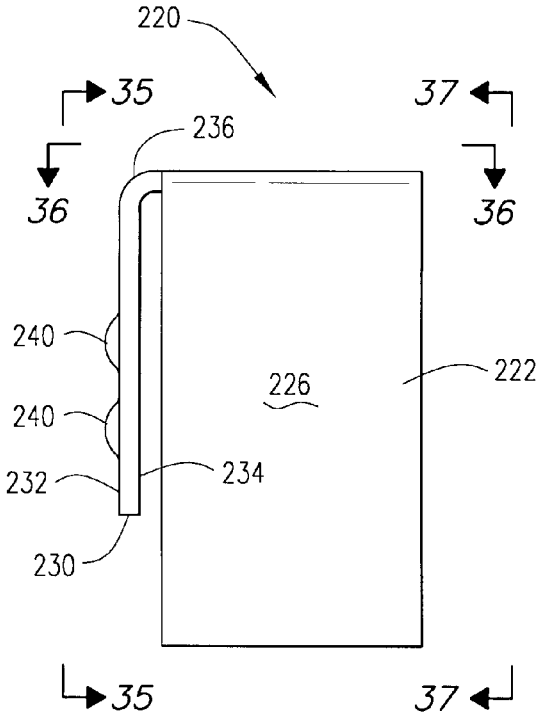
FIG. 33 is a front elevational view of the bracket shown in FIG. 32.

The welding current is of sufficient of magnitude, and applied for sufficient time, so that the electrical resistance of the bracket 138 causes the projection 176 contacting the upright member 96 to heat up and at least partially melt. Current flow is then terminated, and the melted portions of the projection cool to form a weld 180, as shown in FIG. 30. The resulting weld 180 is situated within the rail channel 98 and joins an upright member 96 to a bracket 138. Indentation 178 is situated immediately opposite the weld 174, as shown in FIGS. 30 and 31.

In order to enhance the strength of the weld 180, the bracket 138 and/or upright member 96 is preferably compressed during the periods of current flow and cooling, such that the projection 176 is pressed against upright member 96. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Other aspects of the welding process are identical to those described with reference of the embodiment of FIGS. 1-10. Additional upright members 96 may be attached to additional brackets 138 by repeating the steps described above.

The welds 180 may be formed after formation of all of the welds 174 required to form a fence panel 82. Alternatively, some or all of the welds 174 and 180 may be formed simultaneously, or in alternation. Likewise, some or all of the welds 174 and 180 may be formed simultaneously with the welds required to secure the lower rails 88 to their respective upright members 96. Aside from the differences just noted, the components and methods of assembly and installation of a fence 80 and panel 82 using bracket 138 are identical to those described with reference to the embodiment of FIGS. 1-10.

FIGS. 32-40 show another bracket 220 that may be used to form the mechanical connection between each upright member 96 and upper rail 86 in the panel 82 and fence 80 of the type shown in FIGS. 15-17. The bracket 220 is preferably formed from the same material as the upper rail 86 and is characterized by the same thickness as the upper rail 86. The width of the bracket 220 should permit it to be clearingly inserted within the channel 98 of upper rail 86.

As best shown in FIGS. 32-33 and 35-37, the bracket 220 comprises a brace section 222 that is preferably characterized by a U-shaped cross section. The brace section 222 is characterized by a web 224, preferably substantially planar, and a pair of opposed side walls 226 and 228, also preferably planar, which depend from opposite edges of the web 224. The side walls 226 and 228 are preferably disposed in spaced and parallel relationship. As shown in FIG. 38, the height of each side wall 226 and 228 preferably approaches, but is slightly less than, the height of each side wall 92 and 94 of upper rail 86. The lateral spacing of the side walls 226 and 228 is preferably slightly less than the width of rail channel 98. This sizing permits the bracket 220 to be fully received within the rail channel 98, with the respective webs and side walls of the bracket 220 and upper rail 86 in contact, as shown in FIG. 38.

As shown in FIGS. 32-33 and 35-37, the bracket 220 further comprises a tab section 230, preferably substantially planar, which is characterized by opposed first and second surfaces 232 and 234. The length of tab section 230, measured from web 224, is preferably less than the height of the side walls 226 and 228. For example, if the height of side walls 226 and 228 is about 1.5 inches, the length of tab section 230 might be about 1 inch. The brace and tab sections 222 and 230 are preferably oriented, at least initially, at a 90 degree angle.

The junction between brace and tab sections 222 and 230 should be rectilinear. Preferably, the brace and tab sections 222 and 230 are integral, with the junction therebetween comprising a bend 236 in the material from which the bracket 220 is formed. The bracket 220 is preferably formed from a flat sheet, similar to that shown in FIG. 23, in substantially the same way as described with reference to the embodiment of FIGS. 23-31.

Figure 39:
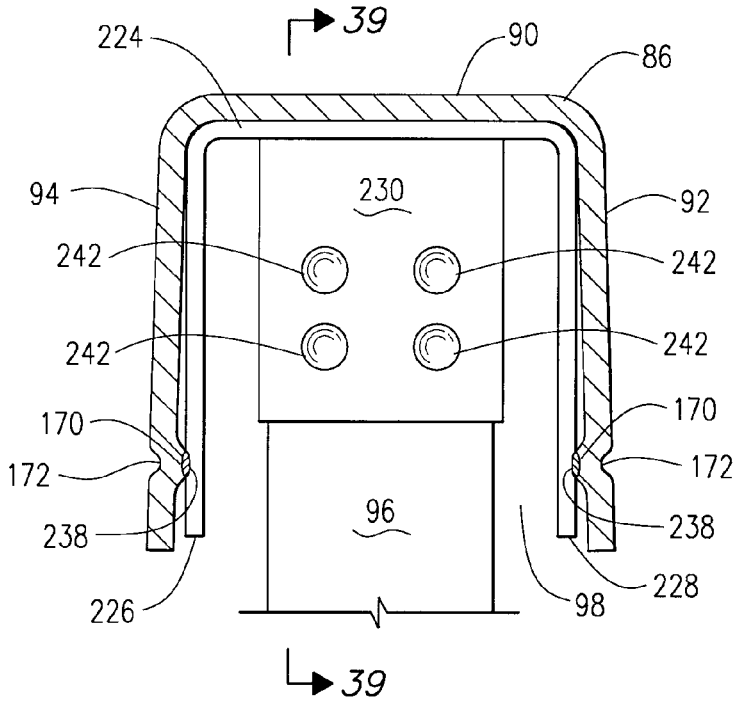
FIG. 39 is a cross-sectional view of the assembled upper rail, bracket and upright member shown in FIG. 38, taken along line 39-39.
Figure 39:
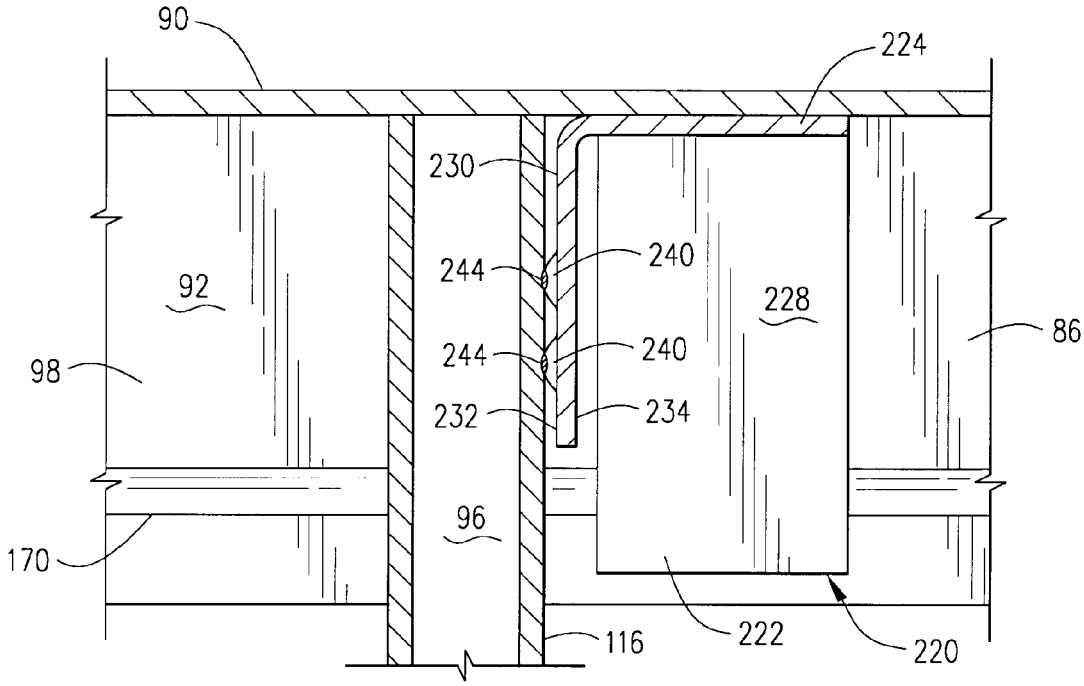
Figure 40:
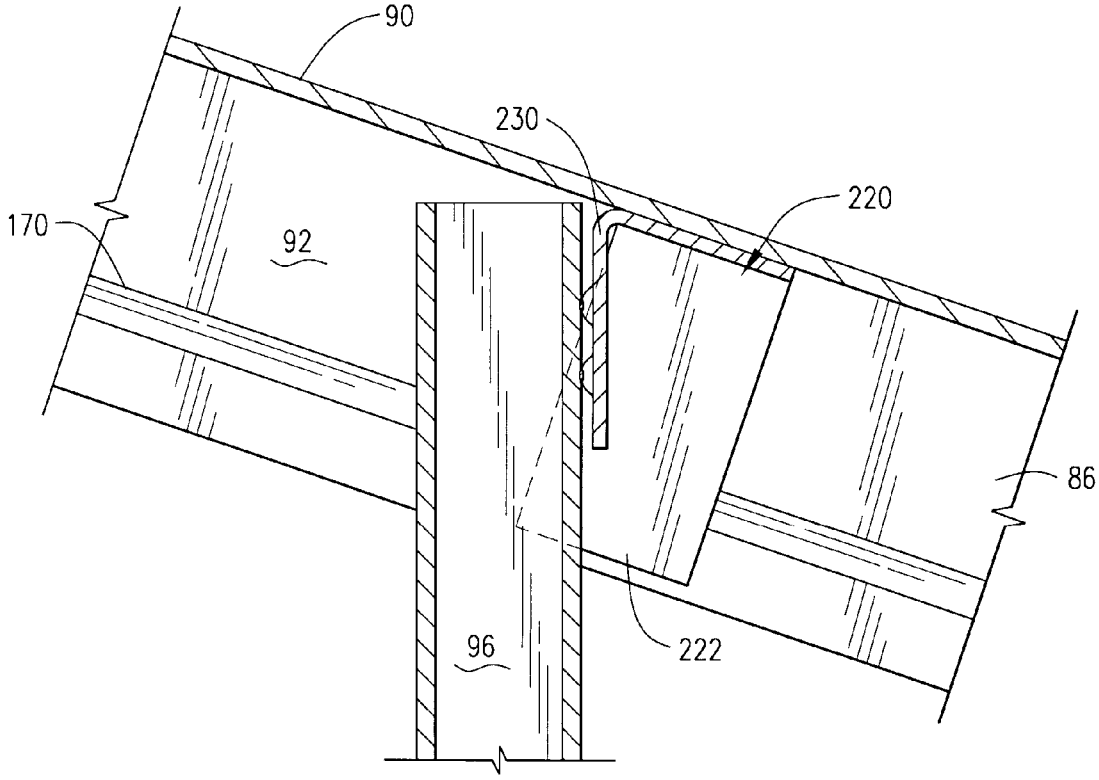
FIG. 40 is a cross-sectional view of the assembled upper rail, bracket and upright member shown in FIG. 38, showing the upright member in a tilted position to the upper rail.

In the embodiment of bracket 220 shown in FIGS. 32-40, the width of tab section 230 is less than the spacing of side walls 226 and 228. This spacing permits tab section 230 to be rotated around bend 236 to a position partially underlying web 224 and between the side walls 226 and 228, as shown in FIG. 40.

With reference to FIGS. 38 and 39, the bracket 220 is inserted into the upper rail 86 such that the brace section 222 contacts the web 90 and side walls 92 and 94 of upper rail 86, and such that the tab section 230 traverses the rail channel 98, in transverse relationship thereto. The bracket 220 is then mechanically secured to the rail 86, preferably at one or more connections formed between the brace section 222 and the side walls 92 and 94. The connection may be formed by a weld, by a permanent adhesive or by a fastener such as a bolt or screw. Preferably, mechanical connections are formed by welds, and more preferably by resistance welds, as described hereafter.

After bracket 220 is installed in upper rail 86, an upright member 96 is inserted into the channel 98 of the upper rail 86, as shown in FIG. 39, so that its upper end abuts the web 90, and such that a side surface 116 contacts the first surface 232 of the tab section 230. The bracket 220 is then secured to the upright member 96 by means of a mechanical connection formed between side surface 116 and first surface 232 of tab section 230. The mechanical connection may be formed by one or more welds, by a permanent adhesive, or by one or more fasteners such as bolts or screws. Preferably, the mechanical connection is formed by one or more welds, and more preferably by resistance welds, as described hereafter.

After assembly with the upright member 96 and upper rail 86, the tab section 230 of bracket 220 may selectively tilted around the rectilinear bend 236, with the bend 236 functioning as a hinge. The upright member 96 which is secured to the tab section 230, is accordingly selectively tiltable with respect to the upper rail 86 within an angular adjustment range, which is preferably characterized by the same absolute maximum adjustment angle as that described with reference to the embodiment of FIGS. 1-14. As illustrated in FIG. 40, this angular adjustment range extends on only a single side of a transverse plane orthogonal to the upper rail 86, such that the included angle between upright member 96 and upper rail 86 is 90 degrees or less. Relative tilting of the upper rail 86 and the upright member 96 occurs around a rectilinear rotational axis which coincides with the axis of bend 236, which is situated within the rail channel 98 adjacent the web 90. In the embodiment of FIGS. 32-40, no openings are formed in the web 90 adjacent any of the tab sections 230.

As noted above, the mechanical connection between the bracket 220 and the upright member 96 and upper rail 86 comprises one or more resistance welds. In this embodiment, a weldable projection 170 which projects within the rail channel 98 is formed on at least one and preferably both of the side walls 92 and 94, as shown in FIG. 38. The projections 170 are preferably identical in size, shape, configuration and orientation to the projecting weld-forming regions described in U.S. patent application Ser. No. 10/140,915, filed May 7, 2002, now U.S. Pat. No. 6,811,145. The projections 170 preferably comprise one or more ridges, as shown in FIG. 38, but may also comprise one or more compact nipple-shaped projections (not shown).

As shown in FIG. 38, indentations 172 are formed in the exterior surfaces of side walls 92 and 94, immediately opposite the corresponding projections 170 formed in the opposite surfaces of the side walls 92 and 94. The indentation 172 should have a profile complementary to that of projection 170.

With reference to FIGS. 38 and 39, the bracket 220 is inserted into the upper rail 86 such that the projection 170 formed in rail side wall 92 contacts side wall 228 and the projection 170 formed in rail side wall 94 contacts side wall 226. The upper rail 86 is contacted with a first electrode (not shown) having a first polarity, and bracket 220 is contacted with a second electrode (not shown) having a second polarity opposed to the first polarity. Preferably, the point of contact for each electrode is near the projections 170. A welding current is then transmitted between the rail-contacting electrode and the bracket-contacting electrode.

The welding current is of sufficient of magnitude, and applied for sufficient time, so that the electrical resistance of the bracket 220 causes the projections 170 contacting each of the side walls 226 and 228 to heat up and at least partially melt. Current flow is then terminated, and the melted portions of each projection cool to form a weld 238, as shown in FIG. 38. The resulting welds 238 are situated within the rail channel 98 and join each side wall of the upper rail 86 to bracket 220. Indentation 172 is situated immediately opposite each weld 238.

In order to enhance the strength of the welds 238, the bracket 220 and/or the upper rail 86 is preferably compressed during the periods of current flow and cooling, such that each of the projections 170 is pressed against its corresponding side wall. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Additional brackets 220 may be attached to the upper rail 86 by repeating the steps described above.

In an alternative embodiment, not shown in the Figures, projections may be formed on the exterior side walls 226 and 228 of bracket 220, rather than on the side walls 92 and 94 of the upper rail 86. The size, shape and configuration the projections are identical to that of projections 170. Other details of the assembly process are identical to that described with reference to the embodiment of FIGS. 1-10.

Figure 34:
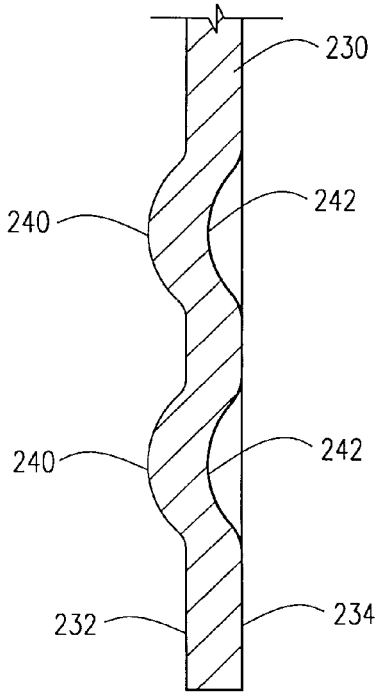
FIG. 34 is an enlarged cross-sectional view of the tab section of the bracket shown in FIG. 33.
Figure 35:
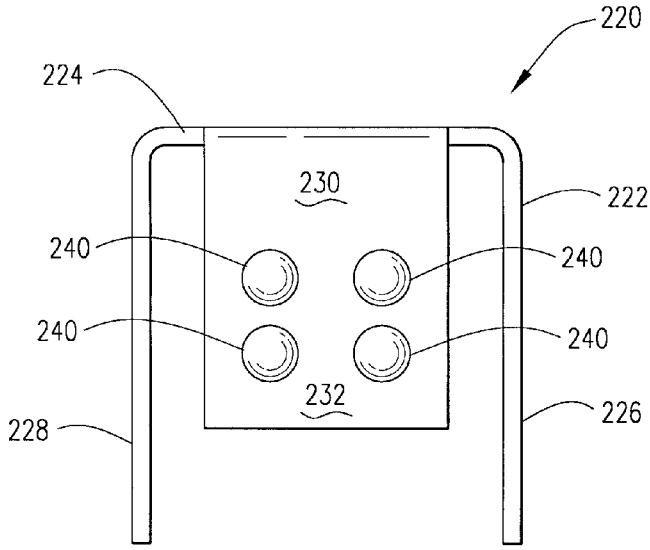
FIG. 35 is a side elevational view of the bracket shown in FIG. 33, taken along line 35-35.
Figure 36:
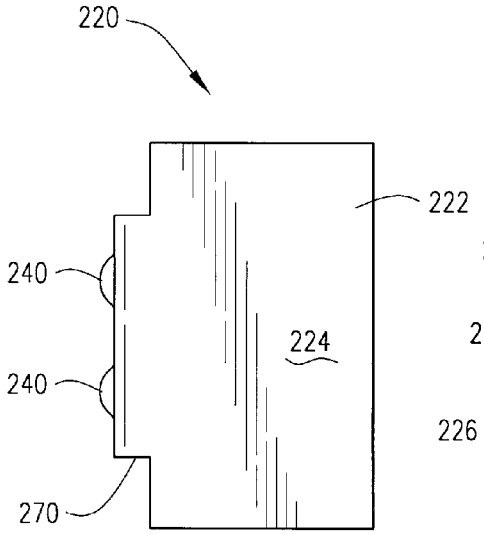
FIG. 36 is a top plan view of the bracket shown in FIG. 33, taken along line 36-36.
Figure 37:
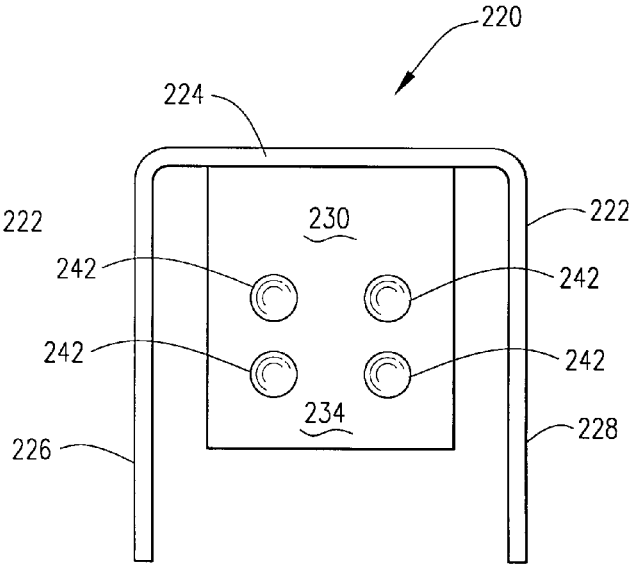
FIG. 37 is a side elevational view of the bracket shown in FIG. 42, taken along line 46-46.

As noted above, the mechanical connection between the bracket 220 and the upright member 96 also preferably comprises one or more resistance welds. In this embodiment, a projection 240 is formed in the first surface 232 of tab section 230. The projection 240 is preferably identical in size, shape, configuration and orientation to the projections 46 described with reference to the embodiment of FIGS. 1-10, or the projections 68 described with reference to the embodiment of FIGS. 11-14. Most preferably, as shown in the Figures, the projection 240 comprises four compact projections of circular cross-section, each centered on the corner of a rectangle. The size, shape and arrangement of these projections is preferably the same as that of the compact projections described as preferred with reference to the embodiment of FIGS. 11-14. As shown in FIGS. 34 and 37, an indentation 242 is formed in second surface 234, immediately opposite the projection 242. The indentation 242 should have a profile complementary to that of projection 240.

With reference to FIGS. 38 and 39, an upright member 96 is inserted into the channel 98 of the upper rail 86, such that its upper end abuts the web 90, and side surface 116 of the upright member 96 contacts the projection 240. The upright member 96 is contacted with a first electrode (not shown) having a first polarity, and bracket 220 is contacted with a second electrode (not shown) having a second polarity opposed to the first polarity. Preferably, the point of contact for each electrode is near the projection 240. A welding current is then transmitted between the upright member-contacting electrode and the bracket-contacting electrode.

The welding current is of sufficient of magnitude, and applied for sufficient time, so that the electrical resistance of the bracket 220 causes the projection 240 contacting the upright member 96 to heat up and at least partially melt. Current flow is then terminated, and the melted portions of the projection 240 cools to form a weld 244, as shown in FIG. 39. The resulting weld 244 is situated within the rail channel 98 and joins an upright member 96 to a bracket 220. Indentation 242 is situated immediately opposite the weld 244.

In order to enhance the strength of the weld 244, the bracket 220 and/or upright member 96 is preferably compressed during the periods of current flow and cooling, such that each of the projections 240 is pressed against upright member 96. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Other aspects of the welding process are identical to those described with reference of the embodiment of FIGS. 1-10. Additional upright members 96 may be attached to brackets 220 by repeating the steps described above.

The welds 244 may be formed after formation of all of the welds 238 required to form a fence panel 82. Alternatively, some or all of the welds 238 and 244 may be formed simultaneously, or in alternation. Likewise, some or all of the welds 238 and 244 may be formed simultaneously with the welds required to secure the lower rails 88 to their respective upright members 96. Aside from the differences just noted, the components and methods of assembly and installation of a fence 80 and panel 82 using bracket 220 are identical to those described with reference to the embodiment of FIGS. 1-10.

FIGS. 41-49 show another bracket 250 that may be used to form the mechanical connection between each upright member 96 and upper rail 86 in the panel 82 and fence 80 of the type shown in FIGS. 15-17. The bracket 250 is preferably formed from the same material as the upper rail 86 and is characterized by the same thickness as the upper rail 86. The width of the bracket 250 should permit it to be clearingly inserted within the channel 98 of upper rail 86.

As best shown in FIGS. 41-42 and 44-46, the bracket 250 comprises a brace section 252 that is preferably characterized by a U-shaped cross section. The brace section 252 is characterized by a web 254, preferably substantially planar, and a pair of opposed side walls 256 and 258, also preferably planar, which depend from opposite edges of the web 254. The side walls 256 and 258 are preferably disposed in spaced and parallel relationship. As shown in FIG. 47, the height of each side wall 256 and 258 preferably approaches, but is slightly less than, the height of each side wall 92 and 94 of upper rail 86. The lateral spacing of the side walls 256 and 258 is preferably slightly less than the width of rail channel 98. This sizing permits the bracket 250 to be fully received within the rail channel 98, with the respective webs and side walls of the bracket 250 and upper rail 86 in contact, as shown in FIG. 47.

Figure 41:
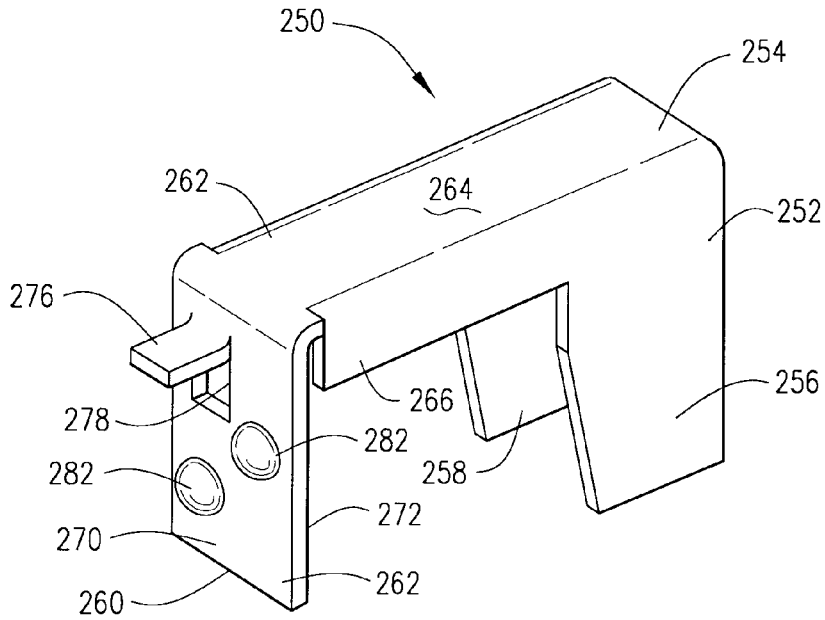
FIG. 41 is a perspective view of another embodiment of a bracket which be used to form a panel like that shown in FIG. 15.
Figure 42:
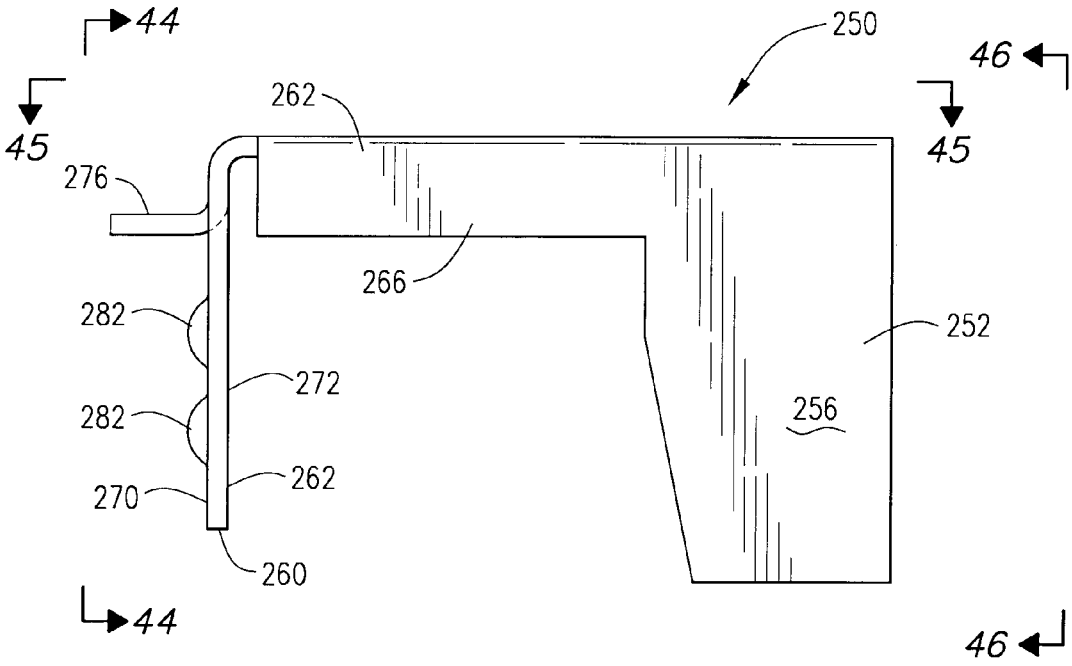
FIG. 42 is a front elevational view of the bracket shown in FIG. 41.

The bracket 250 preferably further comprises a tab section 260, spaced from the brace section 252, and a spacer section 262 joins the tab section 260 to the brace section 262. The brace section 252, spacer section 262 and tab section 260 are preferably integral. The spacer section 262 comprises a web 264, which is coplanar with, and characterized by the same width as, web 254. The spacer section 262 preferably further comprises a pair of spaced sidepieces 266 (one of which is shown in the Figures) which depend from opposite edges of web 254. Each sidepiece 266 is preferably integral with a respective side wall 256 and 258. As shown in FIGS. 41 and 42, the height of each sidepiece 266 is preferably less than the height of its corresponding side wall 256 or 258. The spacing of the sidepieces 266 is preferably equal to that of side walls 256 and 258.

With reference to FIGS. 41-46, the tab section 260 depends from web 264 of spacer section 262 and is preferably characterized by a substantially planar body 268 having opposed first and second surfaces 270 and 272. As shown in FIGS. 41 and 42, the body 268 is not integral with the sidepieces 266, and can be spaced therefrom. The length of body 268, measured from web 264, is preferably less than the height of the side walls 256 and 258. For example, if the height of side walls 256 and 258 is about 1.25 inches, the length of tab section 260 might be about 1 inch. The spacer and tab sections 252 and 260 are preferably oriented, at least initially, at a 90 degree angle, as shown in FIG. 41.

The junction between web 264 of the spacer section 262 and body 268 of tab section 260 should be rectilinear. Preferably, the junction therebetween comprises a bend 274 in the material from which the bracket 250 is formed. The bracket 250 is preferably formed by bending of a flat sheet, similar to that shown in FIG. 23, in substantially the same way as described with reference to the embodiment of FIGS. 23-31.

Figure 44:
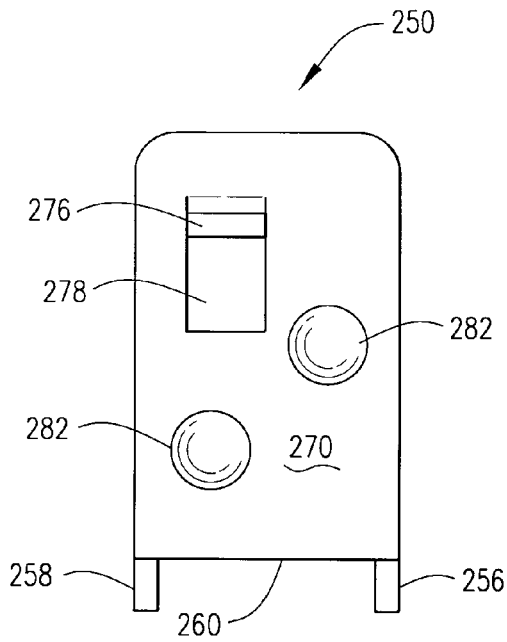
FIG. 44 is a side elevational view of the bracket shown in FIG. 42, taken along line 44-44.
Figure 45:
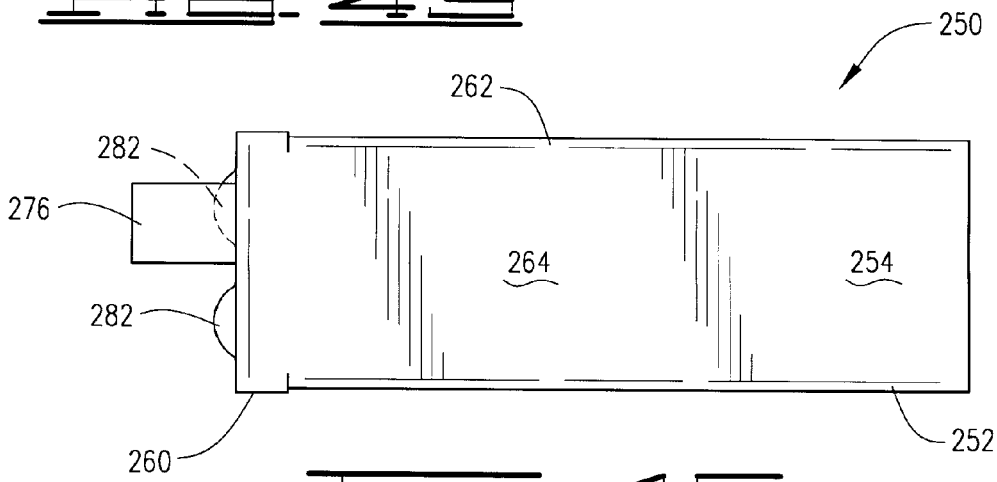
FIG. 45 is a top plan view of the bracket shown in FIG. 42, taken along line 45-45.
Figure 46:
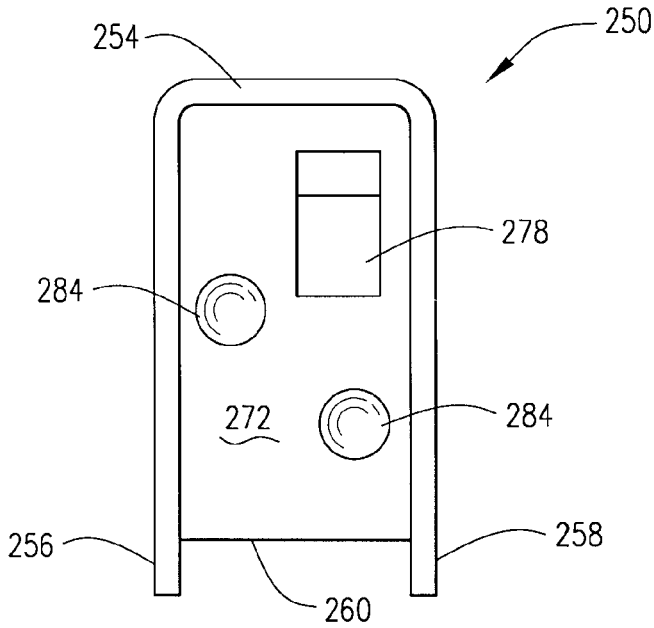
FIG. 46 a side elevational view of the bracket shown in FIG. 42, taken along line 46-46.
Figure 47:
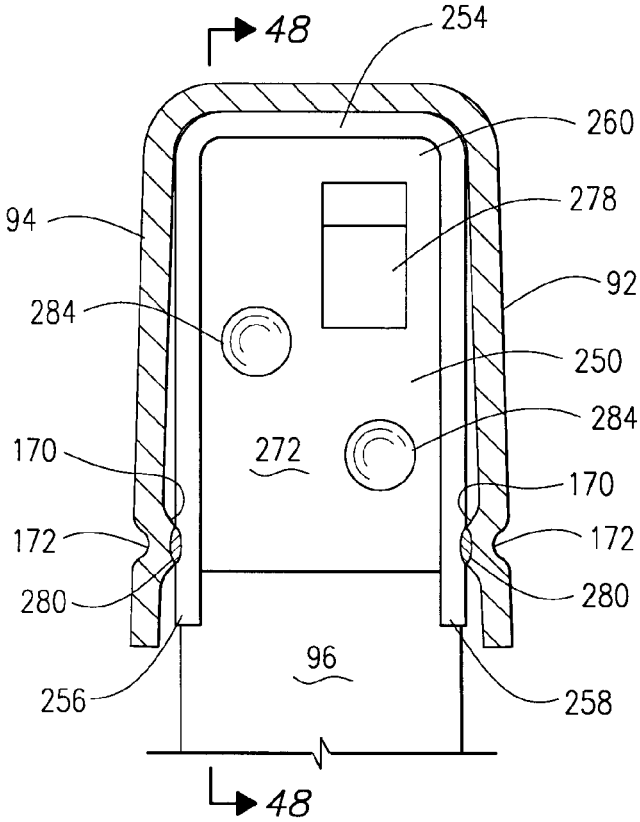
FIG. 47 is a cross-sectional view of the upper rail used to form the panel shown in FIG. 15, in an assembled state with the bracket of FIG. 41 and an upright member.
Figure 4B:
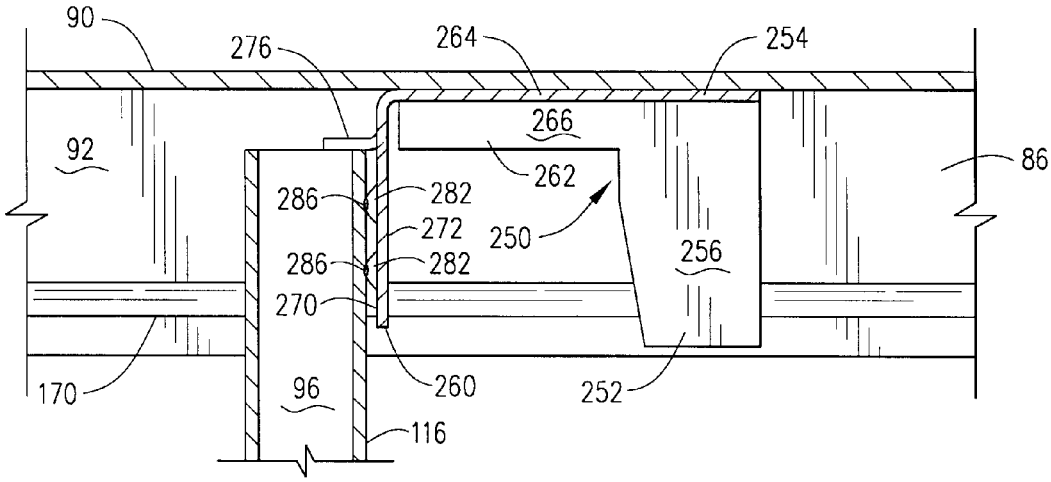
Figure 4B:
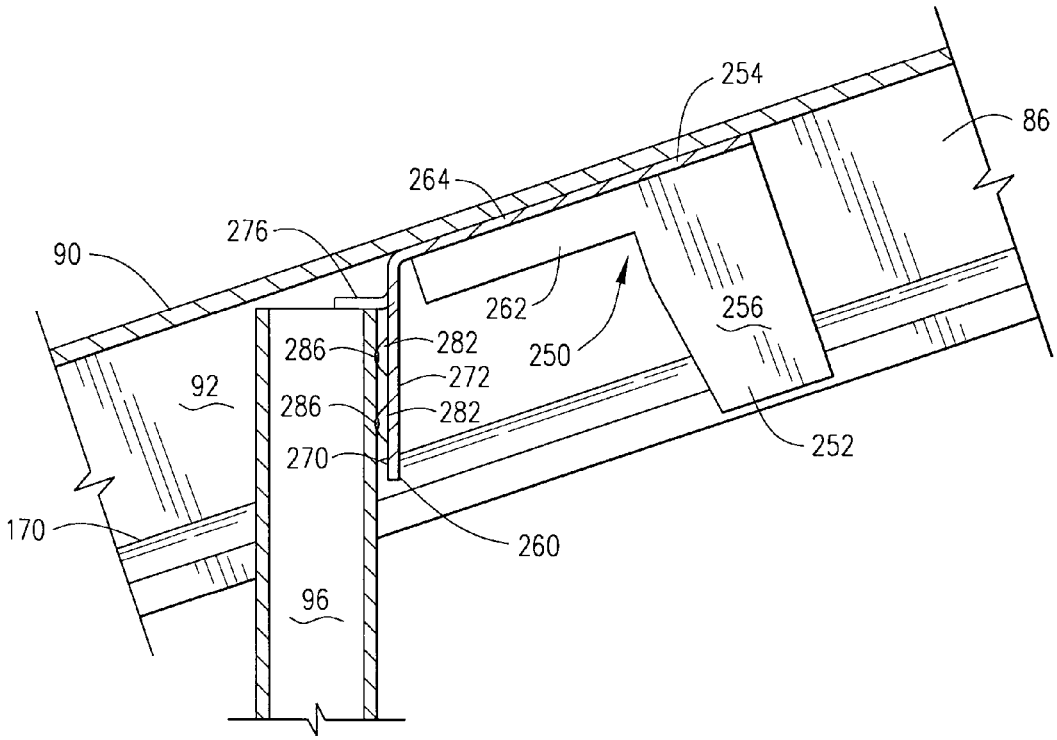
Figure 50:
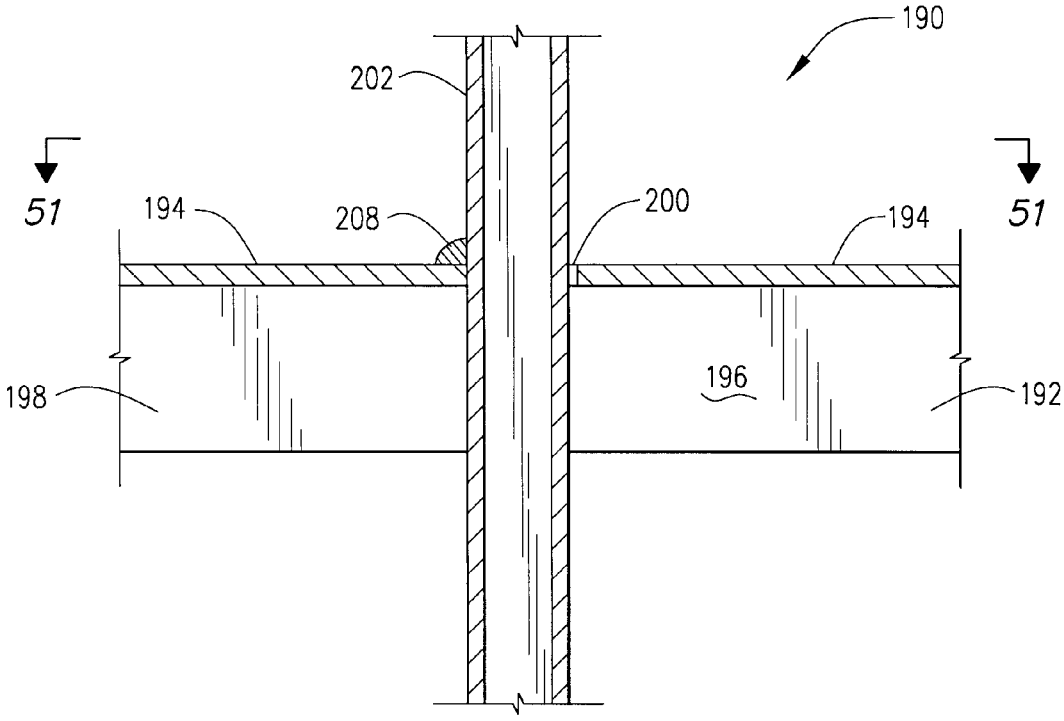
FIG. 50 is a partial front cross-sectional view of another embodiment of the panel of the present invention, showing a rail and upright member.

As shown in FIGS. 44-46, the width of body 268 preferably equals, or is slightly less than, the space of sidepieces 266 and side walls 256 and 268. This sizing of the body 268 allows the sidepieces 266 to block rotation of the tab section 260 toward the side walls 256 and 258. The tab section 260 may rotate freely away from the side walls 256 and 258, as shown in FIG. 49.

The tab section 260 is preferably characterized by a cap element 276, preferably substantially planar and rectangular in shape, which projects from the first surface 270 of body 268. The cap element 276 is spaced from bend 274, and preferably extends in substantially orthogonal relationship to the body 268 of tab section 260. The cap element 276 is preferably formed by making a U-shaped cut in that portion of the flat sheet that will eventually form the body 268. After forming of the bracket 250, the 3-sided piece defined by the cut is bent away from the 268 to form cap element 276, leaving a rectangular opening 278 in body 266, where the piece was formerly situated.

With reference to FIGS. 47 and 48, the bracket 250 is inserted into the upper rail 86 such that the brace section 252 contacts the web 90 and side walls 92 and 94 of upper rail 86, and such that the tab section 260 traverses the rail channel 98, in transverse relationship thereto. The bracket 250 is then mechanically secured to the rail 86, preferably at one or more connections formed between the brace section 252 and the side walls 92 and 94. The connections may be formed by a weld, by a permanent adhesive or by a fastener such as a bolt or screw. Preferably, the mechanical connections are formed by welds, and more preferably by resistance welds, as described hereafter.

After bracket 250 is installed in upper rail 86, an upright member 96 is inserted into the channel 98 of the upper rail 86, as shown in FIG. 48, so that its upper end abuts the cap member 276, which is disposed in spaced relationship to the web 90 of upper rail 86. In this position, side surface 116 of upright member 96 contacts the first surface 270 of the tab section 260. The bracket 250 is then secured to the upright member 96 by means of a mechanical connection formed between side surface 116 and first surface 270 of tab section 260. The mechanical connection may be formed by one or more welds, by a permanent adhesive, or by one or more fasteners such as bolts or screws. Preferably, the mechanical connection is formed by one or more welds, and more preferably by resistance welds, as described hereafter.

After assembly with the upright member 96 and upper rail 86, the tab section 260 of bracket 250 may selectively tilted around the rectilinear bend 274, with the bend 274 functioning as a hinge. The upright member 96 which is secured to the tab section 260, is accordingly selectively tiltable with respect to the upper rail 86 within an angular adjustment range, which is preferably characterized by the same absolute maximum adjustment angle as that described with reference to the embodiment of FIGS. 1-14. As illustrated in FIG. 49, this angular adjustment range extends on only a single side of a transverse plane orthogonal to the upper rail 86, such that the included angle between upright member 96 and upper rail 86 is 90 degrees or more. Relative tilting of the upper rail 86 and the upright member 96 occurs around a rectilinear rotational axis which coincides with the axis of bend 274, which is situated within the rail channel 98 adjacent the web 90. In the embodiment of FIGS. 41-49, no openings are formed in the web 90 adjacent any of the tab sections 260.

As noted above, the mechanical connection between the bracket 250 and the upright member 96 and upper rail 86 comprises one or more resistance welds. In this embodiment, a weldable projection 170 which projects within the rail channel 98 is formed on at least one and preferably both of the side walls 92 and 94, as shown in FIG. 47. The projections 170 are preferably identical in size, shape, configuration and orientation to the projecting weld-forming regions described in U.S. patent application Ser. No. 10/140,915, filed May 7, 2002, now U.S. Pat. No. 6,811,145. The projections 170 preferably comprise one or more ridges, as shown in FIG. 47, but may also comprise one or more compact nipple-shaped projections (not shown).

As shown in FIG. 47, indentations 172 are formed in the exterior surfaces of side walls 92 and 94, immediately opposite the corresponding projections 170 formed in the opposite surfaces of the side walls 92 and 94. The indentation 172 should have a profile complementary to that of projection 170.

With reference to FIGS. 47 and 48, the bracket 250 is inserted into the upper rail 86 such that the projection 170 formed in rail side wall 92 contacts side wall 258 and the projection 170 formed in rail side wall 94 contacts side wall 256. The upper rail 86 is contacted with a first electrode (not shown) having a first polarity, and bracket 250 is contacted with a second electrode (not shown) having a second polarity opposed to the first polarity. Preferably, the point of contact for each electrode is near the projections 170. A welding current is then transmitted between the rail-contacting electrode and the bracket-contacting electrode.

The welding current is of sufficient of magnitude, and applied for sufficient time, so that the electrical resistance of the bracket 250 causes the projections 170 contacting each of the side walls 256 and 258 to heat up and at least partially melt. Current flow is then terminated, and the melted portions of each projection cool to form a weld 280, as shown in FIG. 47. The resulting welds 280 are situated within the rail channel 98 and join each side wall of the upper rail 86 to bracket 250. An indentation 172 is situated immediately opposite each weld 280.

In order to enhance the strength of the welds 280, the bracket 250 and/or the upper rail 86 is preferably compressed during the periods of current flow and cooling, such that each of the projections 170 is pressed against its corresponding side wall. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Additional brackets 250 may be attached to the upper rail 86 by repeating the steps described above.

In an alternative embodiment, not shown in the Figures, projections may be formed on the exterior side walls 256 and 258 of bracket 250, rather than on the side walls 92 and 94 of the upper rail 86. The size, shape and configuration the projections are identical to that of projections 170. Other details of the assembly process are identical to that described with reference to the embodiment FIGS. 1-10.

Figure 43:
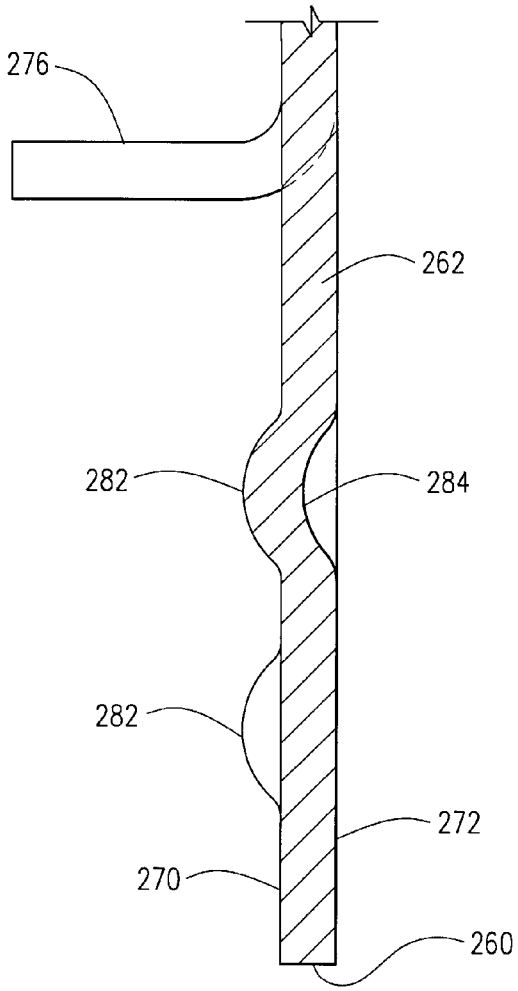
FIG. 43 is an enlarged cross-sectional view of the tab section of the bracket shown in FIG. 42.

As discussed above, the mechanical connection between the bracket 250 and the upright member 96 also preferably comprises one or more resistance welds. In this embodiment, a projection 282 is formed in the first surface 270 of tab section 260. The projection 282 is preferably identical in size, shape, configuration and orientation to the projections 46 described with reference to the embodiment of FIGS. 1-10, or the projections 68 described with reference to the embodiment of FIGS. 11-14. Most preferably, as shown in the Figures, the projection 282 comprises two compact projections of circular cross-section, each centered on diagonally opposite corners of a rectangle. The size and shape of these projections is preferably the same as that of the compact projections described as preferred with reference to the embodiment of FIGS. 11-14. As shown in FIGS. 43 and 46, an indentation 284 is formed in second surface 272, immediately opposite the projection 284. The indentation 284 should have a profile complementary to that of projection 282.

With reference to FIGS. 47 and 48, an upright member 96 is inserted into the channel 98 of the upper rail 86, such that its upper end abuts the cap element 276, and side surface 116 of the upright member 96 contacts the projection 282. The upright member 96 is contacted with a first electrode (not shown) having a first polarity, and bracket 250 is contacted with a second electrode (not shown) having a second polarity opposed to the first polarity. Preferably, the point of contact for each electrode is near the projection 282. A welding current is then transmitted between the upright member-contacting electrode and the bracket-contacting electrode.

The welding current is of sufficient of magnitude, and applied for sufficient time, so that the electrical resistance of the bracket 250 causes the projection 282 contacting the upright member 96 to heat up and at least partially melt. Current flow is then terminated, and the melted portions of the projection 282 cools to form a weld 286, as shown in FIG. 48. The resulting weld 286 is situated within the rail channel 98 and joins an upright member 96 to a bracket 250. Indentation 284 is situated immediately opposite the weld 286.

In order to enhance the strength of the weld 286, the bracket 250 and/or upright member 96 is preferably compressed during the periods of current flow and cooling, such that each of the projections 282 is pressed against upright member 96. The electrodes are preferably used to apply this compressive force. A method and machine that may be adapted to perform these welding steps are described in U.S. patent application Ser. No. 10/140,915, filed May 15, 2002, now U.S. Pat. No. 6,811,145, and Ser. No. 10/666,105, filed Sep. 18, 2003. Other aspects of the welding process are identical to those described with reference of the embodiment of FIGS. 1-10. Additional upright members 96 may be attached to additional brackets 250 by repeating the steps described above.

The welds 286 may be formed after formation of all of the welds 280 required to form a fence panel 82. Alternatively, some or all of the welds 280 and 286 may be formed simultaneously, or in alternation. Likewise, some or all of the welds 280 and 286 may be formed simultaneously with the welds required to secure the lower rails 88 to their respective upright members 96. Aside from the differences just noted, the components and methods of assembly and installation of a fence 80 and panel 82 using bracket 250 are identical to those described with reference to the embodiment of FIGS. 1-10.

The embodiments of FIGS. 1-49 have been described with primary reference to a mechanical connection formed with welds produced by resistance welding process. However, other types of welds may be used to form such a connection. For example, edge welds may be formed manually, or by a robotic process, around the area of contact between the tab and the upright member. Likewise, spot welds may be formed manually or robotically while the tab and upright member are in contact, through small openings formed in the tab.

FIGS. 50-53 show another embodiment of the barrier and panel of the present invention. The panel 190 has the same general configuration as the panel 16 shown in FIG. 1, and includes at least one, and preferably a plurality of spaced and parallel rails 192. Each rail 192 is characterized by an elongate web 194, which is preferably flat, and a pair of spaced side walls 196, preferably depend from opposite edges of the web 194, preferably in orthogonal relationship to the web 194. The web 194 and side walls 196 cooperate to define a rail channel 198. The rail 192 is preferably formed from the same material, is characterized by the same dimensions, and manufactured by the same process as the rail 18 described with reference to FIGS. 1-10. In the embodiment of FIGS. 50-53, the web 194 is characterized by a plurality of longitudinally spaced openings 200, each opening sized to clearingly receive an upright member 202 therethrough. The openings 200 are preferably identical to the openings 36 described with reference to FIGS. 1-10. In other embodiments, only the lower rails forming the panel are provided with openings, while the uppermost rail has no such openings.

The panel 190 further comprises at least one, and preferably a plurality of upright members 202. The upright members 202 are preferably formed from the same material as rail 192, and are preferably identical in construction to the upright members 20 described with reference to FIGS. 1-10. Each upright member 202 extends in transverse relationship to each rail 192 and traverses the rail channel 198 of each such rail 192. If the web 194 of a rail 192 is provided with openings 200, the upright member should extend through a corresponding opening 200. In this event, a sufficient number of openings 200 should be formed in the web 194 so that each upright member 202 may pass through an associated opening.

Each upright member 202 is mechanically connected to each rail 194, such that the upright member 202 may selectively tilted with respect to the rail 194 within an angular adjustment range. The angular adjustment range for panel 190 is preferably the same as that described with reference to the panel 16 shown in FIGS. 1-10. Relative tilting of each rail 192 and each upright member 202 preferably occurs around a rectilinear axis of rotation 204 which extends transversely to the rail 192 and is situated at or adjacent the web 194 at its point of contact with upright member 202. When the rail 192 includes openings 200, this axis 204 preferably coincides with or is immediately adjacent to a rectilinear edge of the opening 200 through which the upright member 202 extends, as shown in FIG. 51.

Figure 51:
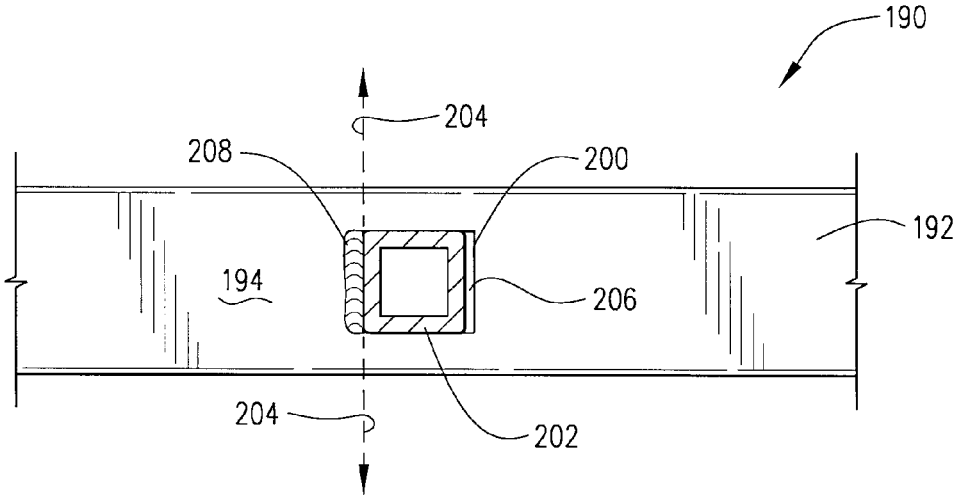
FIG. 51 is a top view of the rail and upright member shown in FIG. 50, taken along line 51-51
Figure 52:
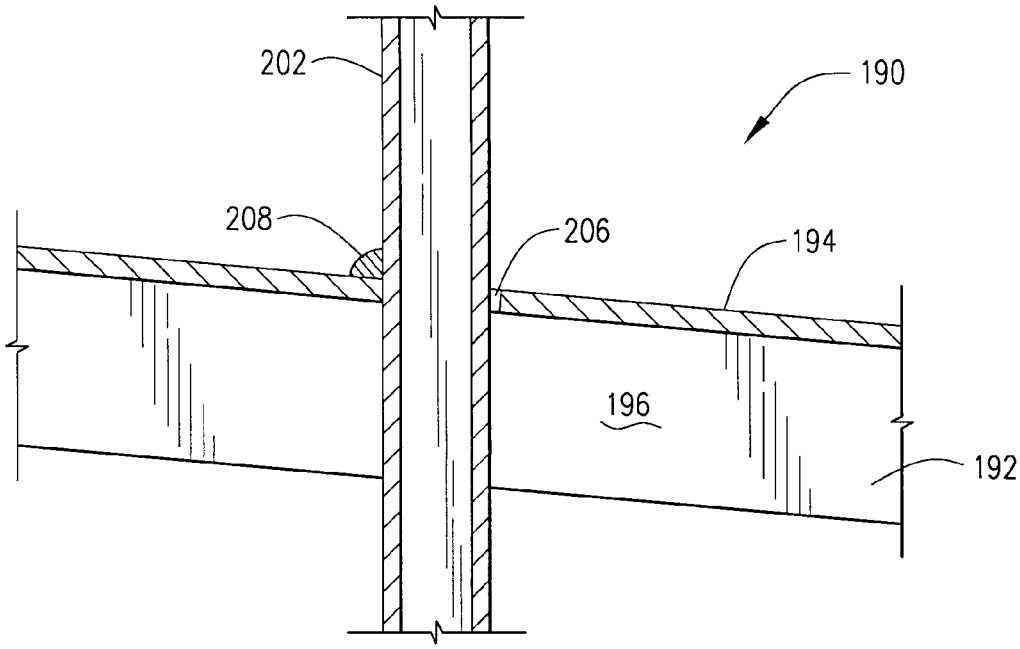
FIG. 52 is a front cross-sectional view of the rail and upright member of FIG. 50, in which the upright member has been tilted with respect to the rail at a first adjustment angle.
Figure 53:
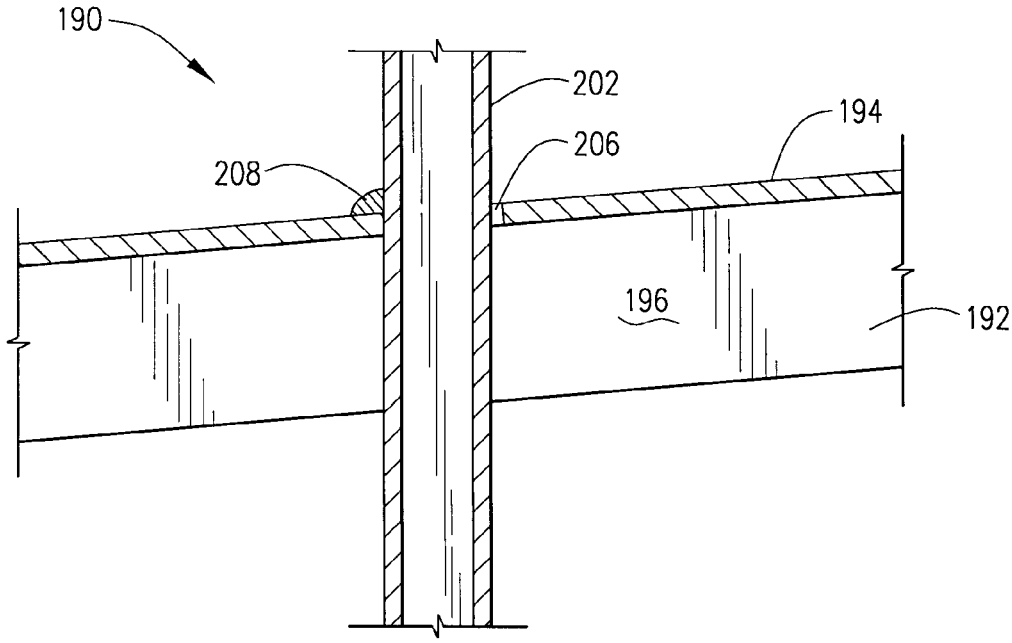
FIG. 53 is a front cross-sectional view of the rail and upright member of FIG. 50, in which the upright member has been tilted with respect to the rail at a second adjustment angle.

With continued reference to FIG. 51, each opening 200 should be sized so that an area of clearance 206 exists between the opening 200 and the upright member 202, on the side of the upright member opposite the axis of rotation 204. This area of clearance 206 permits the upright member 202 to tilted in either direction away from a perpendicular orientation with respect to rail 192, within the angular adjustment range, as shown in FIGS. 52 and 53.

In the embodiment shown in FIGS. 50-53, the mechanical connection between each upright member 202 and each rail 192 comprises a rectilinear weld 208 which extends in transverse relationship to the rail 192, preferably at or adjacent the web 204 at a rectilinear edge of opening 200, if the rail 192 includes such openings. The weld 208 should be formed at the rectilinear junction between upright member 202 and rail 192. In FIGS. 50-53, the weld 204 is situated outside the rail channel 98, on the exterior surface of web 194. The weld 208 may be formed by melting filler material at the junction between upright member 202 and rail 192 to form a bead, or by any other suitable welding process. Other features of the panel 190, including its assembly and method of installation, are identical to those described with reference to panel 16 shown in FIGS. 1-10.

Figure 54:
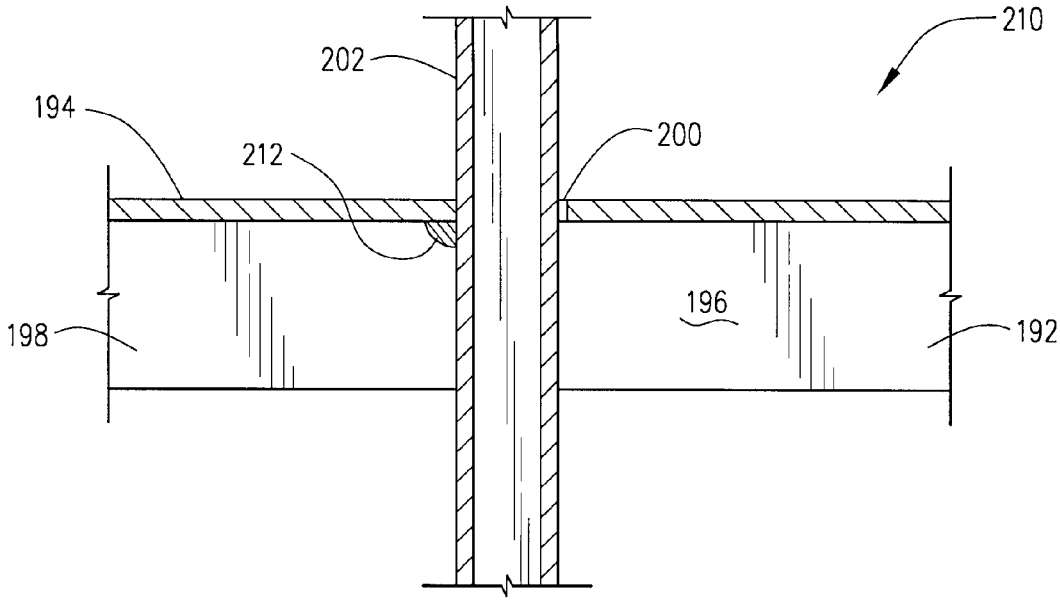
FIG. 54 is a partial front cross-sectional view of another embodiment of the panel of the present invention, showing a rail and upright member.

FIG. 54 shows an alternative embodiment of the panel of the present invention, generally designed by reference numeral 210. The panel 210 is formed from rails 192 and upright members 202 in a manner identical to that described with reference to the panel 190 shown in FIGS. 50-53. The only difference in construction is in the placement of rectilinear weld 212, which is situated within the rail channel 198, immediately adjacent the web 194, rather than on the exterior surface of web 194 as in FIGS. 50-53. This internal placement of weld 212 may be particularly advantageous when no openings are formed in the web of a rail. Other features of the panel 210, including its assembly and method of installation, are identical to those described with reference to panel 190.

Figure 55:
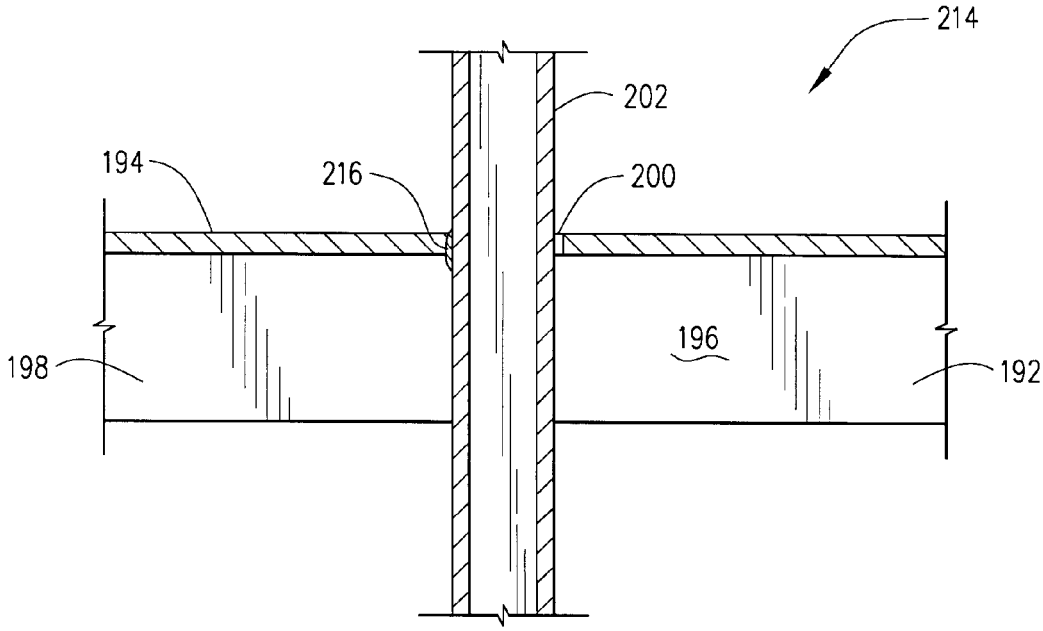
FIG. 55 is a partial front cross-sectional view of another embodiment of the panel of the present invention, showing a rail and upright member.

FIG. 55 shows another alternative embodiment of the panel of the present invention, generally designed by reference numeral 214. The panel 214 is formed from rails 192 and upright members 202 in a manner identical to that described with reference to the panel 190 shown in FIGS. 50-53. The only difference in construction is the use of a rectilinear layer of permanent adhesive 216, rather than a weld, to form the mechanical connection between the upright member 202 and rail 192. The adhesive layer 216 is applied at the joint between upright member 202 and rail 192, immediately adjacent web 194. Use of such an adhesive may be advantageous when the material from which the upright members 202 and/or rails 192 are formed is not conducive to welding. Other features of the panel 214, including its assembly and method of installation, are identical to those described with reference to panel 190.

Barriers of the present invention may be assembled from, and the methods of the invention advantageously practiced with, a kit. The kit of the present invention preferably comprises a plurality of barriers, such as the panels 16 shown in FIG. 1, and a plurality of posts 12, each post 12 connectable to the end of a barrier rail 18. Alternately, the kit may comprise a plurality of the panels 82 shown in FIG. 15, and a plurality of posts 84, each post 84 connectable to the ends of an upper and lower rails 86 and 88. The posts are preferably provided in a number sufficient to form the fence, or section thereof, to be installed, with a pair of posts available for each panel to be installed.

The kit preferably further comprises a plurality of connectors, such as the brackets 52 shown in FIG. 1, for installation on the posts and connection to the rails. The kit preferably further comprises a plurality of fasteners, such as the fasteners 54 shown in FIG. 1, and associated holders, for securing the ends of the rails to the connectors. The connectors, fasteners and holders should be provided in a number sufficient to permit interconnection of the rails of each panel with the posts.

In the preceding description, several welding processes and assemblies have been described in which a weld is formed at a junction between two contacting pieces, such as a rail and a bracket, or a tab and an upright member, with one of the pieces having a projection formed thereon, while the other piece is smooth. In alternate embodiments not shown in the Figures, the welding step may be carried out, and an assembly formed, by switching the respective identities of the smooth and projecting pieces. An indentation is formed in the piece having the projection, on the opposite side of the surface at which the weld is formed, immediately opposite the weld. For example, in lieu of the method described with reference to FIGS. 1-14, a projection and indentation may be formed on a side of upright member 20, while the tab 40 remains smooth, without either projections or indentations. Other details of these alternate embodiments, and their construction, assembly and installation, are identical to those described with reference to the Figures.

While the present invention has been described with reference to fences and fence panels, and methods for their assembly and installation, it should be understood that the invention is equally adaptable to any barrier formed from one or more rails and one or more upright member. Other types of barriers that can be formed in accordance with the present invention include balustrades, hand rail systems, guard rail systems, and gates. When the barrier of the present incorporates a hand rail, the upper rail preferably includes no top openings, so that the upper rail presents a smooth and regular surface suitable for gripping by a hand.

Changes may be made in the construction, operation and arrangement of the various parts, elements, steps and procedures described herein without departing from the spirit and scope of the invention as described in the following claims.

What is claimed is:

1. A barrier comprising:

an upper rail comprising:

an elongate web; and a pair of spaced side walls cooperating with the web to define the boundaries of a rail channel; and at least one lower rail comprising:

an elongate web having a plurality of longitudinally spaced openings formed therein;

a pair of spaced side walls cooperating with the web to define the boundaries of a rail channel; and a plurality of longitudinally spaced tabs, each tab formed adjacent a corresponding one of said web openings; and at least one upright member formed from a single unit of material, comprising:

an elongate shaft having opposed ends and extending in transverse relationship to each of the upper and lower rails; and a projecting tab projecting from one of said ends of the shaft;

in which a weld is formed between the projecting tab of the upright member and the upper rail, in which the shaft of the upright member extends through a corresponding one of said openings in the lower rail, in which a weld is formed between the upright member and a corresponding one of said tabs of the lower rail, and in which the tabs of the lower rail are tiltable relative to the web of the lower rail, and in which the shaft of the upright member is tiltable relative to its projecting tab.

2. The barrier of claim 1 in which the weld between the upper rail and the projecting tab of the upright member is formed at the web of the upper rail.

3. The barrier of claim 1 in which the web of the upper rail has no openings formed therein.

4. The barrier of claim 1 in which each of the tabs of the lower rail is planar.

5. The barrier of claim 1 in which each of the tabs of the lower rail is unperforated.

6. The barrier of claim 1 in which the shaft of the upright member is characterized by a planar surface disposed in parallel relationship to the planar surface of its connected tab.

7. The barrier of claim 1 in which the tabs of the lower rail extend within the lower rail channel.

8. A kit comprising:

a plurality of barriers as defined in claim 1;

a plurality of posts, each post connectable to the end of at least one rail of the barrier.

9. A barrier comprising:

an upper rail comprising:

an elongate planar web having no openings formed therein; and a pair of spaced side walls cooperating with the web to define the boundaries of a rail channel; and at least one lower rail comprising:

an elongate planar web having a plurality of longitudinally spaced openings formed therein;

a pair of spaced side walls cooperating with the web to define the boundaries of a rail channel; and a plurality of longitudinally spaced planar tabs, each tab formed adjacent a corresponding one of said web openings, extending within the rail channel and tiltable relative to the web of the lower rail; and at least one upright member comprising:

an elongate shaft having opposed ends and extending in transverse relationship to each of the upper and lower rails; and a projecting planar tab formed adjacent to one of said ends of the shaft;

in which a weld connects the projecting tab of the upright member and the web of the upper rail, in which the shaft of the upright member extends through a corresponding one of said openings in each lower rail, in which a weld connects the upright member to a corresponding one of said tabs of the lower rail and in which the shaft of the upright member is tiltable relative to its projecting tab.

10. The barrier of claim 9 in which the shaft of the upright member is characterized by a planar surface disposed in parallel relationship to the planar surface of its connected tab.

11. The barrier of claim 9 in which each of the tabs of the lower rail is unperforated.

12. A kit comprising:

a plurality of barriers as defined in claim 9;

a plurality of posts, each post connectable to the end of at least one rail of the barrier.

* * * * *